US012628956B1

(12) United States Patent
Massam et al.

(10) Patent No.: US 12,628,956 B1
(45) Date of Patent: May 19, 2026

(54) CLASSROOM CHAIR

(71) Applicant: Academia Furniture, LLC, Wood-Ridge, NJ (US)

(72) Inventors: Daniel Massam, Philadelphia, PA (US); Thomas Murray, Philadelphia, PA (US)

(73) Assignee: Academia Furniture, LLC, Wood-Ridge, NJ (US)

( * ) Notice: Subject to any disclaimer, the term of this patent is extended or adjusted under 35 U.S.C. 154(b) by 0 days.

(21) Appl. No.: 19/373,995

(22) Filed: Oct. 30, 2025

(51) Int. Cl.

| | |
|---|---|
| ***A47C 3/04*** | (2006.01) |
| ***A47B 91/06*** | (2006.01) |
| ***A47C 5/12*** | (2006.01) |
| ***A47C 7/62*** | (2006.01) |
| ***A47C 7/64*** | (2006.01) |

(52) U.S. Cl.
CPC ..... *A47C 5/12* (2013.01); *A47B 91/06* (2013.01); *A47C 3/04* (2013.01); *A47C 7/626* (2018.08); *A47C 7/64* (2013.01)

(58) Field of Classification Search
CPC .. A47C 7/40; A47C 7/626; A47C 3/04; A47C 5/12; A47C 7/64; A47B 91/06
USPC ..... 297/445.1
See application file for complete search history.

(56) References Cited

U.S. PATENT DOCUMENTS

| | | | | |
|---|---|---|---|---|
| 2,747,654 | A | 5/1956 | Chapman et al. | |
| 3,156,498 | A | 11/1964 | Blodee | |
| 3,160,438 | A | 12/1964 | Davis | |
| 3,380,778 | A | 4/1968 | Barecki | |
| 3,497,262 | A | 2/1970 | Piretti et al. | |
| 4,913,496 | A * | 4/1990 | Oke | A47C 3/04 297/297 |
| 5,123,702 | A | 6/1992 | Caruso | |
| 5,924,770 | A | 7/1999 | Tarnay et al. | |
| 6,135,562 | A * | 10/2000 | Infanti | A47C 13/005 297/440.22 |
| 8,454,088 | B2 | 6/2013 | Shokouhi | |
| 8,528,969 | B2 | 9/2013 | Huang | |
| 8,967,714 | B2 | 3/2015 | Machael et al. | |
| 9,826,838 | B2 | 11/2017 | Piretti | |
| 9,986,839 | B2 | 6/2018 | Pectol | |
| 10,485,350 | B2 | 11/2019 | Lenhart et al. | |
| 12,226,030 | B1 * | 2/2025 | Marenco | A47C 5/043 |
| 12,527,401 | B2 | 1/2026 | Gatfield et al. | |
| 2005/0099052 | A1 | 5/2005 | Bertolini et al. | |
| 2005/0151409 | A1 | 7/2005 | Infanti et al. | |
| 2007/0045485 | A1 | 3/2007 | Nichols et al. | |
| 2010/0276971 | A1 | 11/2010 | Maxwell et al. | |
| 2011/0062754 | A1 | 3/2011 | Mills et al. | |

(Continued)

*Primary Examiner* — Alfred J Wujciak
(74) *Attorney, Agent, or Firm* — Weiss & Arons LLP

(57) ABSTRACT

A chair includes a chair back. The chair back houses a steel plate. The chair back defines a first aperture. The chair includes a chair seat that defines a second aperture. The chair includes a steel bracket. The steel bracket connects an underside of the chair seat to the steel plate. The chair includes a first chair support. The first chair support includes two legs and is disposed on a first side of the chair seat. The chair includes a second chair support. The second chair support includes two legs and is disposed on a second side of the chair seat. The chair includes a first bar. The chair includes a second bar. The first chair support and the second chair support run parallel to one another from the back of the chair to the front of the chair.

29 Claims, 35 Drawing Sheets

(56) References Cited

U.S. PATENT DOCUMENTS

| | | | | |
|---|---|---|---|---|
| 2011/0278889 | A1 | 11/2011 | Sienkowski et al. | |
| 2012/0019038 | A1* | 1/2012 | Mezzera | A47C 7/02 297/440.15 |
| 2014/0077573 | A1 | 3/2014 | Schneider et al. | |
| 2022/0265051 | A1 | 8/2022 | Scharfenkamp et al. | |
| 2024/0324780 | A1* | 10/2024 | Ding | A47C 4/03 |

* cited by examiner

Section 9-9

Section 27-27

CLASSROOM CHAIR

FIELD OF TECHNOLOGY

Aspects of the disclosure relate to mechanical designs and apparatus. Specifically, aspects of the disclosure relate to chairs.

BACKGROUND OF THE DISCLOSURE

Chairs may enable people to perform one or more tasks in a sitting position. Chairs are used in various settings. The settings may include a dining setting, a conference setting and a classroom setting.

Conventionally, in a classroom setting, other furniture, in addition to chairs, may be required. Other such furniture may include hooks to hold belongings, such as coats and bookbags. Other such furniture may also include shelves to store books.

At times, the hooks and shelves occupy space in a classroom. A classroom that includes other furniture in addition to chairs may appear cluttered. A cluttered classroom may hinder the learning that transpires in the classroom.

Therefore, it would be desirable to create a chair that would minimize the furniture required in a classroom. Such a chair may include a hook to hold belongings. Such a chair may include a basket to store books.

It should be noted that chairs may be stacked while not in use. Stacking chairs may be instrumental to ensuring that floor space is available when needed. As such, it would be further desirable for such a chair to be stackable in addition to including both a hook and a basket.

SUMMARY OF THE DISCLOSURE

Aspects of the disclosure relate to a chair. The chair may include a chair back. The chair may include a chair seat. The chair may include a bracket. The chair may include a first chair support. The chair may include a second chair support. The chair may include a first bar. The chair may include a second bar.

The chair may include a chair back. The chair back may be formed from a material. The material may be a poly-molded material. The material may be any material listed in Table 1.

TABLE 1

| Illustrative materials.<br>Illustrative Materials. |
|---|
| Polyethylene<br>Polypropylene<br>Polyurethane<br>Polystyrene<br>Polycarbonate<br>Plastic<br>Any suitable polymer<br>Any suitable material<br>Any suitable combination thereof |

The chair back may be formed using injection molding. Injection molding, for purposes of the application, may be understood to refer to a manufacturing process that produces parts by injecting molten material into a mold. In some embodiments, the chair back may be formed using other processes. For example, over molding, insert molding, co-injection molding and/or any other suitable chair back forming processes.

The chair back may house a metal plate. The metal plate may include a steel plate. The metal plate may include any material listed in Table 2.

TABLE 2

| Illustrative materials.<br>Illustrative Materials. |
|---|
| Steel<br>Aluminum<br>Metal<br>Any suitable material<br>Any suitable combination thereof |

The poly-molded material may be molded around the metal plate. The metal plate may increase strength in the chair back. The metal plate may include a height. The height may include any height listed in Table 3.

TABLE 3

| Illustrative Heights<br>Illustrative Heights. |
|---|
| <1 inch<br>1-2 inches<br>2-3 inches<br>3-4 inches<br>>4 inches<br>Any other suitable height<br>Any suitable combination thereof |

The metal plate may include a width. The width may include any width listed in Table 4.

TABLE 4

| Illustrative Widths<br>Illustrative Widths. |
|---|
| <4 inches<br>4-5 inches<br>5-6 inches<br>6-7 inches<br>7-8 inches<br>8-9 inches<br>>9 inches<br>Any other suitable width<br>Any suitable combination thereof |

The metal plate may include a shape. The shape may be square. The shape may be rectangular. The shape may include rounded edges. The shape may be any other suitable shape.

The metal plate may include a front face. The metal plate may include a back face. The front face may be opposite the back face.

The chair back may include a weight. Preferably, the weight may be 4.4 pounds. The weight may be any other suitable weight. The weight may include any weight listed in Table 5.

TABLE 5

| Illustrative Weights<br>Illustrative Weights. |
|---|
| <1 pounds |
| 1-2 pounds |
| 2-3 pounds |
| 3-4 pounds |
| 4-5 pounds |
| 5-6 pounds |
| 6-7 pounds |
| 7-8 pounds |
| 8-9 pounds |
| >9 pounds |
| Any other suitable weight |
| Any suitable combination thereof |

The chair back may include a shape. The shape may include a linear bend. The linear bend may bend across a horizontal axis. The linear bend may separate the chair back into two portions. The two portions may include an upper portion and a lower portion. The linear bend may define an obtuse angle between the upper portion and the lower portion. The obtuse angle may face the back of the chair.

The obtuse angle may provide comfort to a user using the chair. The obtuse angle may prevent the chair from falling back. The obtuse angle may not interfere with enabling the chair to stack on top of another chair.

The chair back may define a first aperture. The first aperture may be defined within the lower portion of the chair back. The first aperture may include a size. The size may be smaller than the size of the metal plate. The size may be any other suitable size. The first aperture may include a height. The height may include any height listed in Table 3. The first aperture may include a width. The width may include any width listed in Table 4.

The first aperture may expose a portion of the front face of the metal plate. The first aperture may expose a portion of the back face of the metal plate. The first aperture may include a shape. The shape may be a rectangular shape. The shape may be any other suitable shape.

The bracket may include six apertures. The bracket may include any other suitable number of apertures. The metal plate may include six apertures. The metal plate may include any other suitable number of apertures. The bracket may be mounted to the metal plate at the front face. When the bracket is mounted to the front face of the metal plate, the front face of the metal plate may be hidden from view.

The bracket may be mounted via screws, nuts, bolts, adhesives, welding and/or any other suitable method of mounting. The chair may include screws for mounting the bracket. Preferably, the chair may include six screws. The chair may include any other suitable number of screws. The bracket may be mounted via the six screws. The screws may be threaded through the apertures. The screws may be threaded through the steel plate. The screws may eject at the back face of the steel plate. A nut may be affixed to the portion of each of the screws that ejects at the back face of the steel plate.

The chair may include a cover. The cover may be formed from a poly-molded material. The cover may be formed from any material listed in Table 1. The cover may include a height. The height may include any height listed in Table 3. The height may correspond to the height of the first aperture. The cover may include a width. The width may include any width listed in Table 4. The width may correspond to the width of the first aperture. As such, the cover may fit securely within the first aperture. When the cover is placed within the first aperture, the back face of the metal plate and the screws may be hidden from view.

The chair back may define a U-shaped cavity. The U-shaped cavity may be defined within the upper portion of the chair back. The U-shaped cavity may be used as a hook. The U-shaped cavity may be used as a hook to hold one or more items. The one or more items may include a bookbag, a shopping bag, a coat, a jacket and/or any other suitable items. The U-shaped cavity may be used as a handle. A user may use the handle to move or lift the chair.

When the hook of the chair is holding one or more items, the obtuse angle of the chair back may prevent the chair from tumbling backward. The U-shaped cavity may not interfere with stacking of the chair. The U-shaped cavity may hold up to 1, 3, 5, 7 or 7½ pounds, or any other suitable weight, without tipping the chair.

The chair may include a chair seat. The chair seat may define a back-to-front axis. The back of the back-to-front axis may be adjacent with the chair back. As such, the back-to-front axis may run from a back of the chair seat to a front of the chair seat. The back-to-front axis may be roughly orthogonal to a plane defined by the chair back.

The chair seat may be formed from a material. The material may be a poly-molded material. The material may be any material listed in Table 1. The chair seat may be formed using injection molding. The chair seat may be formed using any other suitable method.

The chair seat may include a weight. Preferably, the weight may be 2.8 pounds. The weight may be any other suitable weight. The weight may be any weight listed in Table 5.

The chair seat may include a seat pan. The seat pan may be designed to have a user sit within the seat pan. The seat pan may provide the user with comfort.

The chair seat may include an extension. The extension may extend around the seat pan. The extension may include a right-side extension. The right-side extension may extend at a right-side of the seat pan. The extension may include a left-side extension. The left-side extension may extend at a left-side of the seat pan. The extension may include a rear facing lip. The rear facing lip may extend at a rear side of the seat pan. The extension may not extend in a front of the seat pan.

The rear facing lip may form an angle with respect to the seat pan. Preferably, the angle may be 129.8°. The angle may be any other suitable angle. The angle may include any angle listed in Table 6.

TABLE 6

| Illustrative angles.<br>Illustrative Angles. |
|---|
| <90° |
| 90°-110° |
| 110°-120° |
| 120°-130° |
| 130°-140° |
| 140°-150° |
| 150°-160° |
| 160°-170° |
| 170°-180° |
| >180° |
| Any other suitable angle |

The rear facing lip may include a curvature. The lower portion of the seat back may include a curvature. The curvature of the rear facing lip may correspond to the curvature of the lower portion of the seat back. At times, the curvature of the chair seat may be identical, or mirror, the curvature of the lower portion of the chair back. The corresponding curvature may enhance the comfort of the chair.

The chair seat may define a second aperture. The second aperture may be defined within the rear facing lip. The second aperture may be engaged with a bracket.

The chair seat may include an underside. The underside of the chair seat may include ridges. The ridges may include apertures. The apertures may be used for mounting the chair seat to the chair back.

The chair may include a bracket. The bracket may include any material listed in Table 2. The bracket may be mounted to the underside of the chair seat. The bracket may be mounted to the ridges on the underside of the chair seat.

The bracket may include a weight. Preferably, the weight may include 1.8 pounds. The weight may include any other suitable weight. The weight may include any weight listed in Table 5.

The bracket may be mounted using the apertures included in the ridges. The bracket may be mounted via screws, nuts, bolts, adhesives, welding and/or any other suitable method of mounting. The bracket may be engaged within the second aperture. The bracket may extend through the second aperture. The bracket may be mounted to the steel plate. The bracket may be mounted via screws, nuts, bolts, adhesives, welding and/or any other suitable method of mounting. The bracket may mount the chair seat to the chair back.

The chair may include a first chair support. The first chair support may be formed from steel. The first chair support may be formed from any material listed in Table 2. The first chair support may include a coating finish. The first chair support may include a powder coat. The first chair support may include any other suitable coat.

The first chair support may extend parallel to the back-to-front axis. The first chair support may be disposed on a first side of the chair seat. The first side of the chair seat may be the right-side of the seat pan.

The first chair support may include two legs. The first chair support may include a front leg. The first chair support may include a back leg. The first chair support may include a first stretcher.

The first stretcher may be disposed between the front leg and the back leg. The first stretcher may connect with the front leg at a substantially right angle. The first stretcher may connect with the front leg at any other suitable angle. The first stretcher may connect with the back leg at a rake angle. The first stretcher may connect with the back leg at any other suitable angle.

The first chair support may be constructed from a single rod. The rake angle may increase the strength of the chair. As such, the chair may be prevented from tumbling. The chair may be prevented from tumbling when a user tips the chair and/or when a user places a weight on the chair back.

The chair may include a second chair support. The second chair support may be formed from steel. The second chair support may be formed from any material listed in Table 2. The second chair support may include a coating finish. The second chair support may include a powder coat. The second chair support may include any other suitable coat.

The second chair support may extend parallel to the back-to-front axis. The second chair support may be disposed on a second side of the chair seat. The second side of the chair seat may be the left-side of the seat pan.

The second chair support may include two legs. The second chair support may include a front leg. The second chair support may include a back leg. The second chair support may include a second stretcher.

The second stretcher may be disposed between the front leg and the back leg. The second stretcher may connect with the front leg at a substantially right angle. The second stretcher may connect with the front leg at any other suitable angle. The second stretcher may connect with the back leg at a rake angle. The second stretcher may connect with the back leg at any other suitable angle.

The second chair support may be constructed from a single rod. The rake angle may increase the strength of the chair. As such, the chair may be prevented from tumbling. The chair may be prevented from tumbling when a user tips the chair and/or when a user places a weight on the chair back.

The chair may include a first bar. The first bar may be formed from steel. The first bar may be formed from any material listed in Table 2. The first bar may include a coating finish. The first bar may include a powder coat. The first bar may include any other suitable coat.

The first bar may connect the first chair support and the second chair support. The first bar may connect the first chair support to the second chair support. The first bar may connect the first chair support to the second chair support at the substantially right angle of the first leg and the substantially right angle of the second leg. The first bar may connect the first chair support to the second chair support at any other suitable location on each of the legs. The first bar may be concealed within the chair seat. As such, the first bar may not interfere with legs of a user sitting on the chair.

The chair may include a second bar. The second bar may be formed from steel. The second bar may be formed from any material listed in Table 2. The second bar may include a coating finish. The second bar may include a powder coat. The second bar may include any other suitable coat.

The second bar may connect the first chair support and the second chair support. The second bar may connect the first chair support to the second chair support. The second bar may connect the first chair support to the second chair support at the rake angle of the first leg and the rake angle of the second leg. The second bar may connect the first chair support to the second chair support at any other suitable location. The second bar may be formed around the steel bracket. The second bar may be concealed within the chair seat. As such, the second bar may not interfere with stacking the chair.

The first chair support, the second chair support, the first bar and the second bar may include a weight. Preferably, the weight may include 6.8 pounds. The weight may include any other suitable weight. The weight may include any weight listed in Table 5.

The chair may include a book basket. The book basket may be formed from steel. The book basket may be formed from any other suitable material. The book basket may include a coating finish. The book basket may include a powder coat. The book basket may include any other suitable coating finish.

The book basket may include a weight. Preferably, the weight may be 2.9 pounds. The weight may include any other suitable weight. The weight may include any weight listed in Table 5.

The book basket may include a curvature. The curvature of the book basket may match a curvature of the first chair support. The curvature of the book basket may match a curvature of the second chair support. The curvature may match a curvature of the chair seat.

The book basket may be mounted to the chair. The book basket may be mounted to the underside of the chair seat. The book basket may be mounted via screws, nuts, bolts, adhesives, welding and/or any other suitable mounting method. The book basket may be connected flush with the underside of the chair seat. The book basket may be connected flush with the legs. As such, when a user is sitting on the chair, the book basket may not interfere with legs of a user. The book basket may be removable. As such, the user may remove the book basket from the underside of the chair.

The chair may include one or more glides. Preferably, the chair may include four glides. Each leg may include a glide. The glide may be located at a bottom of the leg. The glide may be located between the leg and the ground. The glide may enable the chair to move smoothly. The glide may allow the chair to slide.

In some embodiments, the chair may include at least one boot. The chair may include one or more boots. Preferably, the chair may include four boots. The boots may be formed from a poly-molded material. The boots may be formed from any other suitable material listed in Table 1.

Each leg may include one boot. The boot may be located on top of the glide. The boot may include an aperture. The aperture may be engaged by the leg. The boot may include ridges. In some embodiments, the chair may not include at least one boot.

BRIEF DESCRIPTION OF THE DRAWINGS

The objects and advantages of the disclosure will be apparent upon consideration of the following detailed description, taken in conjunction with the accompanying drawings, in which like reference characters refer to like parts throughout, and in which.

Figure 1:
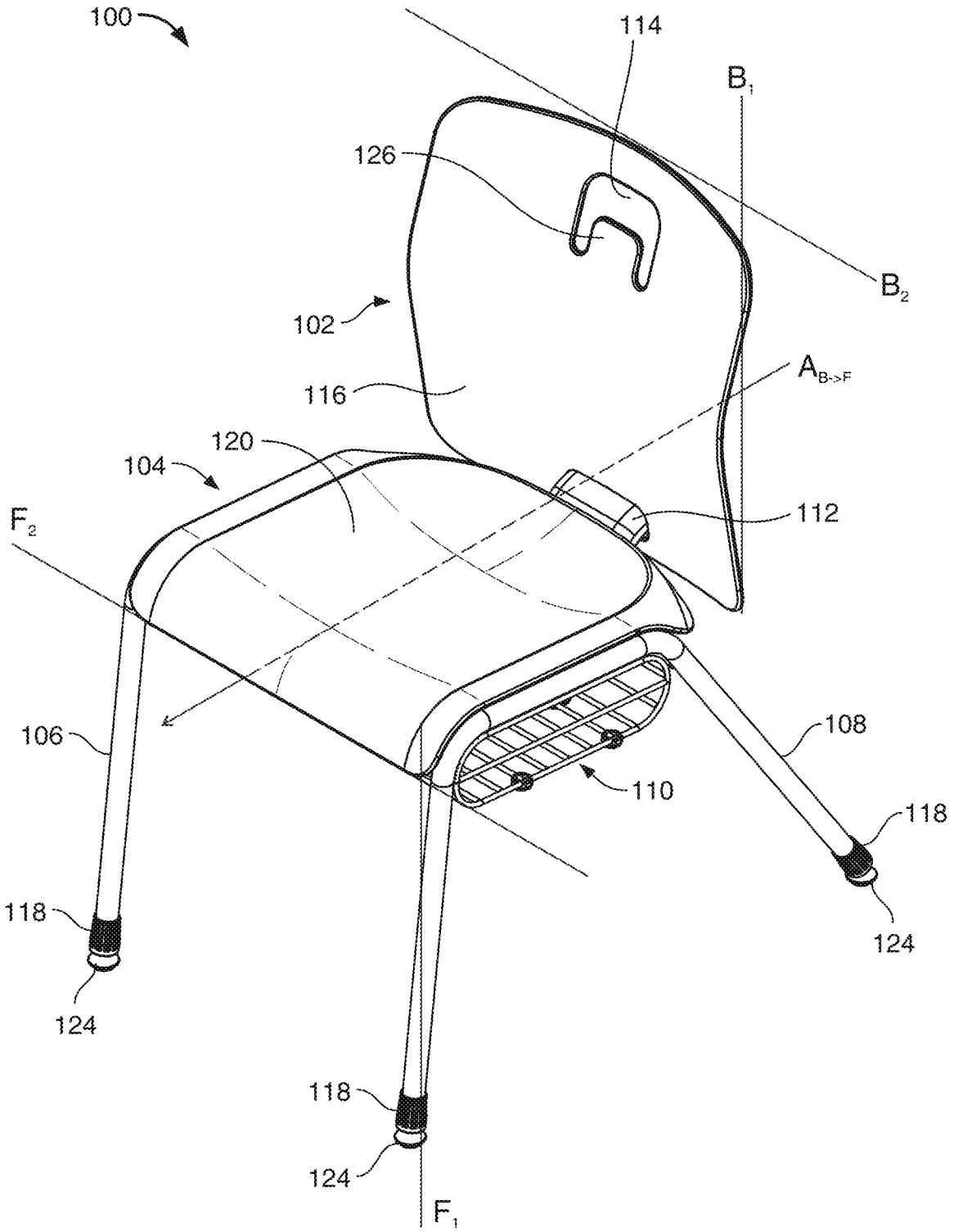
FIG. 1 shows an illustrative apparatus in accordance with principles of this matter.

The leftmost digit (e.g., "L") of a three-digit reference numeral (e.g., "LRR"), and the two leftmost digits (e.g., "LL") of a four-digit reference numeral (e.g., "LLRR"), generally identify the first figure in which a part is called-out.

DETAILED DESCRIPTION OF THE DISCLOSURE

A chair is provided. The chair may include a chair back. The chair may include a chair seat. The chair may include a bracket. The chair may include a chair support.

The chair may include a chair back. The chair back may be formed from a material. The chair back may be formed from any material listed in Table 1.

The chair back may include a shape. The shape may include a linear bend. The linear bend may be across a horizontal axis. The linear bend may separate an upper portion of the chair back from a lower portion of the chair back.

The chair back may define an obtuse angle with respect to the chair back. The obtuse angle may be defined between the upper portion of the chair back and the lower portion of the chair back. The obtuse angle may increase comfort of the chair. The obtuse angle may increase strength of the chair. The obtuse angle may not interfere with stacking of the chair.

The chair back may house a plate. The plate may be formed from steel, metal, aluminum and/or any other suitable material. The plate may be housed within the lower portion of the chair back. The plate may increase the strength of the chair back. The plate may be used to connect the chair back to the chair seat.

The chair back may define a first aperture. The first aperture may be defined within the lower portion of the chair back. The first aperture may expose at least a portion of the plate. The first aperture may expose a front portion of the plate. The first aperture may expose a back portion of the plate. The front portion of the plate may be opposite the back portion of the plate.

The chair may include a chair seat. The chair seat may define a back-to-front axis. The back-to-front axis may be adjacent to the chair back. As such, the back-to-front axis may run from a back of the chair seat to a front of the chair seat.

The chair seat may include a seat pan. The seat pan may be designed to have a user sit within the chair seat. The seat pan may provide the user with comfort.

The chair seat may include a rear facing lip. The rear facing lip may extend at the back of the seat pan. The rear facing lip may form an angle with respect to the seat pan. The angle may be 129.8°. The angle may include any other suitable angle. The angle may include any angle listed in Table 6. The rear facing lip may include a curvature. The curvature may correspond to a curvature of the lower portion of the chair back.

The rear facing lip may define a second aperture. The second aperture may be engaged by a bracket. The second aperture may be engaged to mount the chair seat to the chair back.

The chair may include a bracket. The bracket may be formed from steel, metal, aluminum and/or any other suitable material. The bracket may connect the chair seat to the plate. The bracket may extend through the second aperture.

The chair may include a chair support. The chair support may include two legs. The chair support may include any other suitable number of legs. Each leg may include a first base. Each leg may include a second base. The chair support may include two bars. The chair support may include any other suitable number of bars.

The chair support may support the chair. The chair support may be disposed underneath the chair seat. Each leg may be disposed at a side of the chair seat. A first leg may be disposed at a first side of the chair seat. A second leg may be disposed at a second side of the chair seat. The two bars may be disposed between the first leg and the second leg. The two bars may be disposed underneath the chair seat.

A first of the two bars may be disposed underneath a front end of the chair seat. A second of the two bars may be disposed underneath the rear facing lip of the chair seat. The second bar may be disposed around the bracket. As such, the second bar may increase the strength of the chair.

The chair support may be configured to support the chair back, the chair seat and the bracket. A portion of the chair support may extend beyond the chair seat. As such, the chair support may prevent the chair from tumbling back.

The chair may include a cover. The cover may be configured to fit into the first aperture. The cover may cover the exposed portion of the back face of the plate. The cover may be formed from any suitable material listed in Table 1.

The chair may define a hook handle. The hook handle may be defined within the upper portion of the chair back. The hook handle may be used as a hook. The hook may hold a bookbag, jacket and/or any other suitable item. The hook handle may be used as a handle. The chair may be lifted using the handle. The chair may be moved using the handle.

The chair may include a book basket. The book basket may be connected flush with the underside of the chair seat. As such, the book basket may not interfere with the legs of a user when sitting on the chair.

The book basket may store one or more items. The one or more items may be placed into the book basket from a first side. The book basket may include a second side. The second side may include a stopper. The stopper may prevent the one or more items from falling out of the book basket.

Apparatus and methods described herein are illustrative. Apparatus and methods in accordance with this disclosure will now be described in connection with the figures, which form a part hereof. The figures show illustrative features of apparatus and method steps in accordance with the principles of this disclosure. It is understood that other embodiments may be utilized, and that structural, functional, and procedural modifications may be made without departing from the scope and spirit of the present disclosure. The steps of methods may be performed in an order other than the order shown and/or described herein. Embodiments may omit steps shown and/or described in connection with illustrative methods. Embodiments may include steps that are neither shown nor described in connection with illustrative methods.

Illustrative method steps may be combined. For example, an illustrative method may include steps shown in connection with another illustrative method.

Apparatus may omit features shown and/or described in connection with illustrative apparatus. Embodiments may include features that are neither shown nor described in connection with the illustrative apparatus. Features of illustrative apparatus may be combined. For example, an illustrative embodiment may include features shown in connection with another illustrative embodiment.

The drawings show illustrative features of apparatus and methods in accordance with the principles of the invention. The features are illustrated in the context of selected embodiments. It will be understood that features shown in connection with one of the embodiments may be practiced in accordance with the principles of the invention along with features shown in connection with another of the embodiments.

One of ordinary skill in the art will appreciate that the steps shown and described herein may be performed in other than the recited order and that one or more steps illustrated may be optional. The methods of the above-referenced embodiments may involve the use of any suitable elements, steps, computer-executable instructions, or computer-readable data structures. In this regard, other embodiments are disclosed herein as well that can be partially or wholly implemented on a computer-readable medium, for example, by storing computer-executable instructions or modules or by utilizing computer-readable data structures. For example, methods for producing an apparatus may, in certain embodiments, be wholly or partially executed by designing the apparatus via software, such as computer aided design (CAD) software.

All ranges and parameters disclosed herein shall be understood to encompass any and all subranges subsumed therein, every number between the endpoints, and the endpoints. For example, a stated range of "1 to 10" should be considered to include any and all subranges between (and inclusive of) the minimum value of 1 and the maximum value of 10; that is, all subranges beginning with a minimum value of 1 or more (e.g. 1 to 6.1), and ending with a maximum value of 10 or less (e.g., 2.3 to 10.4, 3 to 8, 4 to 7), and finally to each number 1, 2, 3, 4, 5, 6, 7, 8, 9, and 10 contained within the range.

The classroom chair may include a plurality of different sized classroom chairs. Each size included in the plurality of sizes may include dimensions, as described herein. The dimensions included in the plurality of sizes may be proportional to each other.

FIG. 1 shows illustrative classroom chair 100. Classroom chair 100 may include chair back 102. Chair back 102 may define back axis $B_1$. Chair back 102 may define back axis $B_2$. Back axis $B_1$ and back axis $B_2$ may define a back plane.

Classroom chair 100 may include chair seat 104. Chair seat 104 may define front axis $F_1$. Chair seat 104 may define front axis $F_2$. Front axis $F_1$ and front axis $F_2$ may define a front plane.

Classroom chair 100 may define back-to-front axis $A_{B\rightarrow F}$. Back-to-front axis $A_{B\rightarrow F}$ may extend from the back plane to the front plane. Chair seat 104 may be connected to chair back 102 via bracket 112. Bracket 112 may be a steel bracket. Bracket 112 may be any suitable bracket. Bracket 112 may extend along back-to-front axis $A_{B\rightarrow F}$.

Chair back 102 may include front surface 116. Chair seat 104 may include seat pan 120. When a user sits on classroom chair 100, the user may engage front surface 116 and seat pan 120.

Classroom chair 100 may include chair support 106. Chair support 106 may be mounted to an underside of chair seat 104. Chair support 106 may be mounted via welding, screws, adhesives and/or any other suitable form of attachment. Chair support 106 may extend along back-to-front axis $A_{B\rightarrow F}$.

Classroom chair 100 may include chair support 108. Chair support 108 may be mounted to the underside of chair seat 104. Chair support 108 may be mounted via welding, screws, adhesives and/or any other suitable form of attachment. Chair support 108 may extend along back-to-front axis $A_{B\rightarrow F}$.

When chair support 106 is mounted to the underside of chair seat 104 and chair support 108 is mounted to the underside of chair seat 104, chair support 106 may be parallel to chair support 108. When chair support 106 is mounted to the underside of chair seat 104 and chair support 108 is mounted to the underside of chair seat 104, chair support 106, chair support 108 and bracket 112 may be parallel to each other.

Classroom chair 100 may include boots 118. Boots 118 may be disposed near bottoms of chair support 106 and chair support 108. Classroom chair 100 may include glides 124. Glides 124 may be disposed under bottoms of chair support 106 and chair support 108.

Classroom chair 100 may include book basket 110. Book basket 110 may be attached to the underside of chair seat 104. Book basket 110 may be mounted to the underside of chair seat 104. When book basket 110 is attached to the underside of chair seat 104, book basket 110 may rest flush with an underside of chair support 106 and an underside of chair support 108.

Chair back 102 may define cavity 114. Cavity 114 may be a U-shaped cavity. Cavity 114 may define protrusion 126. Protrusion 126 may be used to hang a book bag, a jacket and/or any other suitable item. Cavity 114 may be used as a handle. Cavity 114 may be used to lift and/or carry classroom chair 100.

Figure 2:
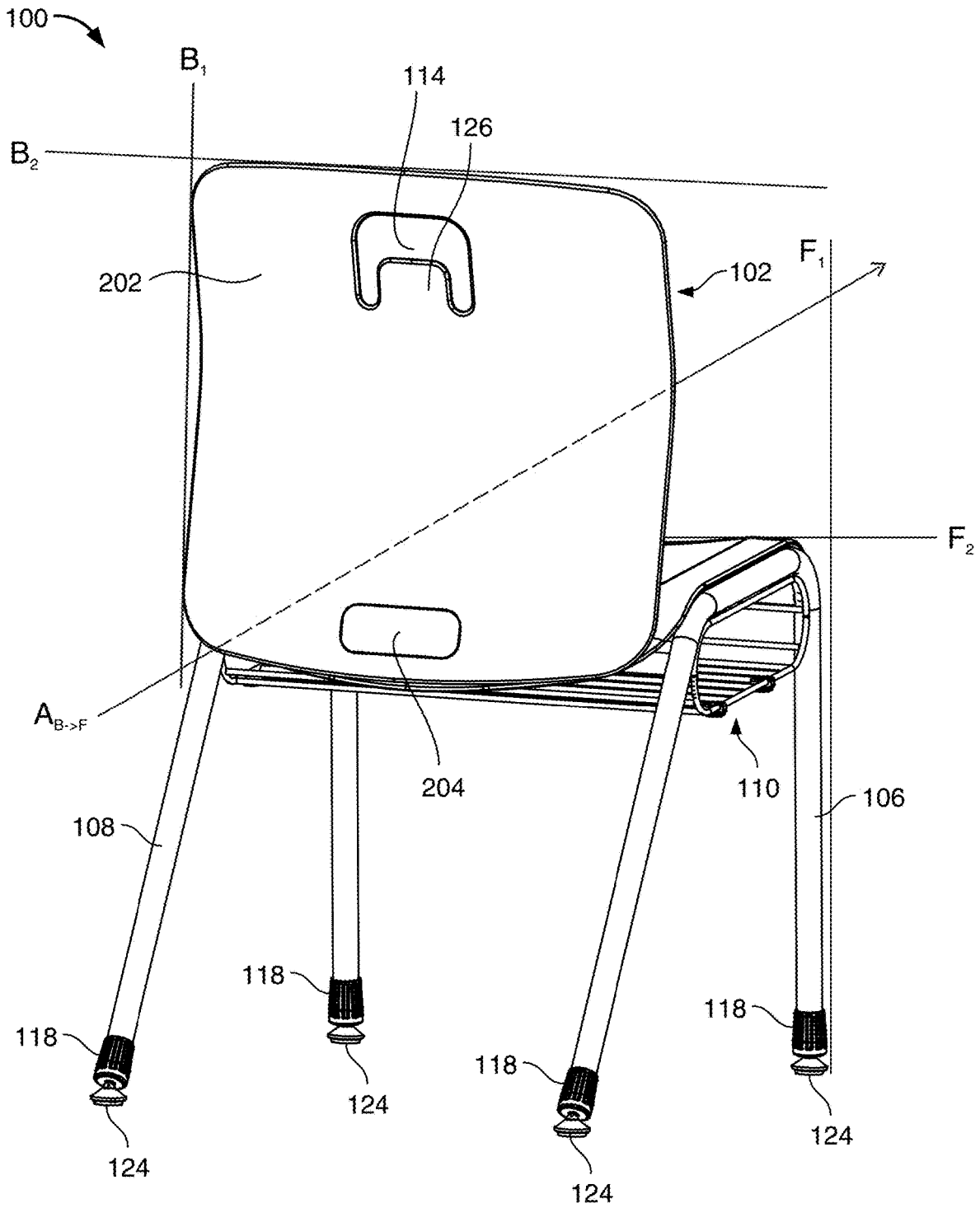
FIG. 2 shows another illustrative apparatus in accordance with principles of this matter.

FIG. 2 shows a back view of classroom chair 100.

Chair back 102 may include back surface 202. Chair back 102 may define an aperture (not shown). Chair back 102 may include cover 204. Cover 204 may be used to cover the aperture.

Figure 3:
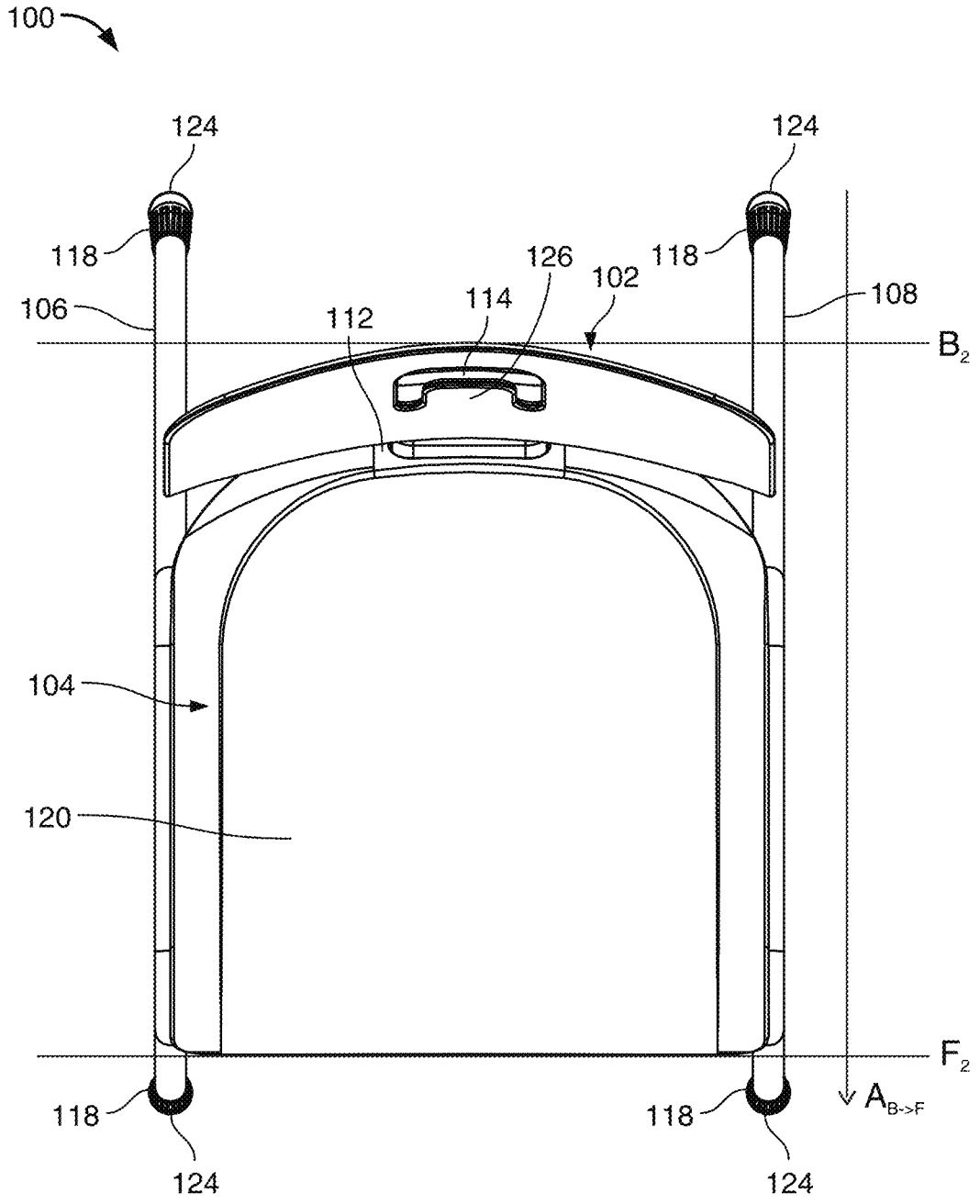
FIG. 3 shows yet another illustrative apparatus in accordance with principles of this matter.

FIG. 3 shows a top view of classroom chair 100.

Figure 4:
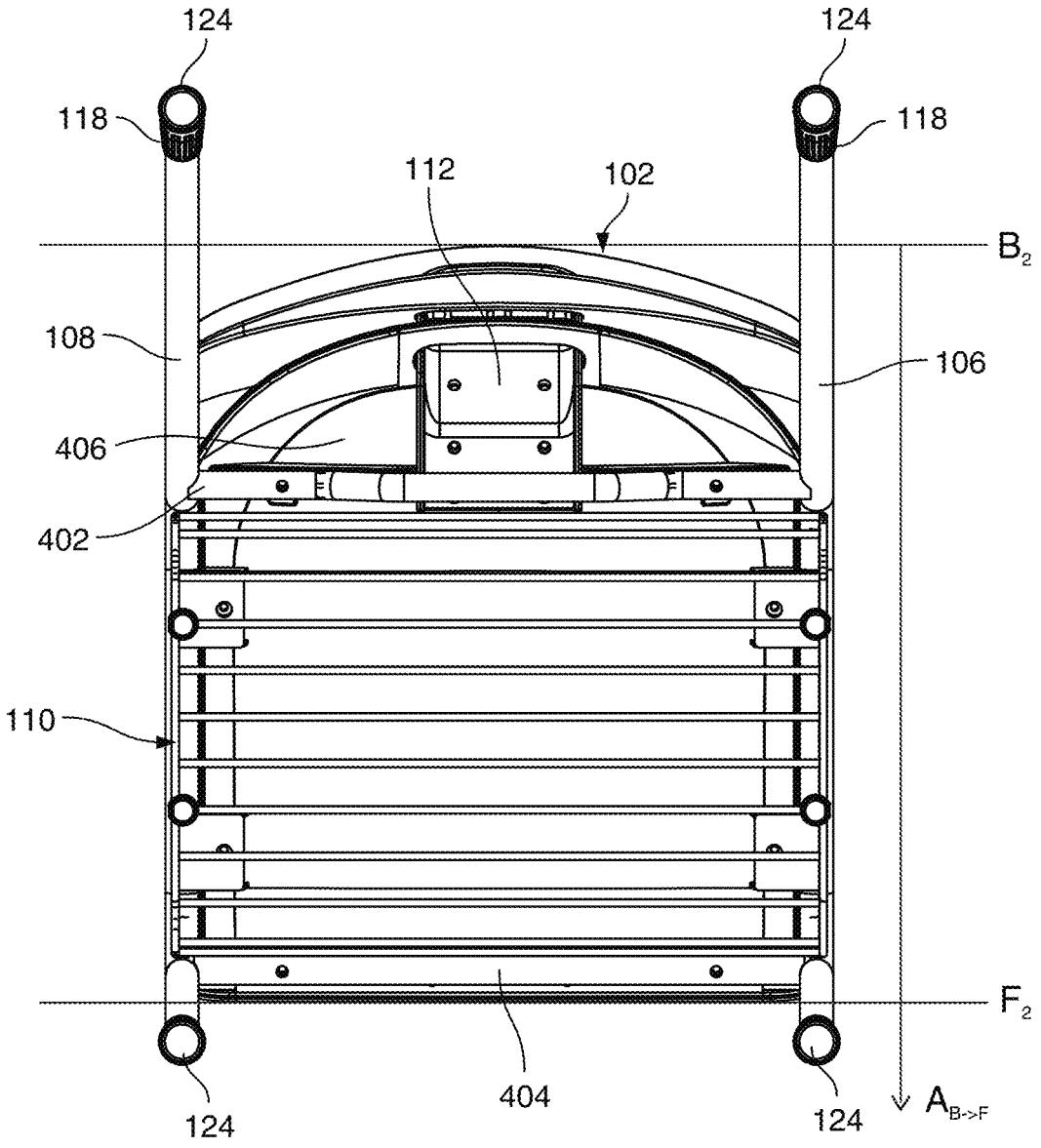
FIG. 4 shows still another illustrative apparatus in accordance with principles of this matter.

FIG. 4 shows a bottom view of classroom chair 100.

Chair seat 104 may include underside 406. Chair support 106 may be mounted to underside 406. Chair support 108 may be mounted to underside 406. Book basket 110 may be mounted to underside 406.

Classroom chair 100 may include bar 402. Bar 402 may be mounted to chair support 106 and chair support 108. Bar 402 may be mounted via welding, adhesives, screws and/or any other suitable attachment mechanism. Bar 402 may extend from chair support 106 to chair support 108. Bar 402 may be mounted at a location that is located towards the back plane. Bar 402 may include angular dips. The angular dips may enable bar 402 to extend around bracket 112. The angular dips may enable bar 402 to extend from chair support 106 to chair support 108 without interfering with bracket 112.

Classroom chair 100 may include bar 404. Bar 404 may be mounted to chair support 106 and chair support 108. Bar 404 may be mounted via welding, adhesives, screws and/or any other suitable attachment mechanism. Bar 404 may extend from chair support 106 to chair support 108. Bar 404 may be mounted at a location that is located towards the front plane.

Bar 404 may be parallel to bar 402. Bar 404 and bar 402 may be substantially perpendicular to chair support 106 and chair support 108.

Figure 5:
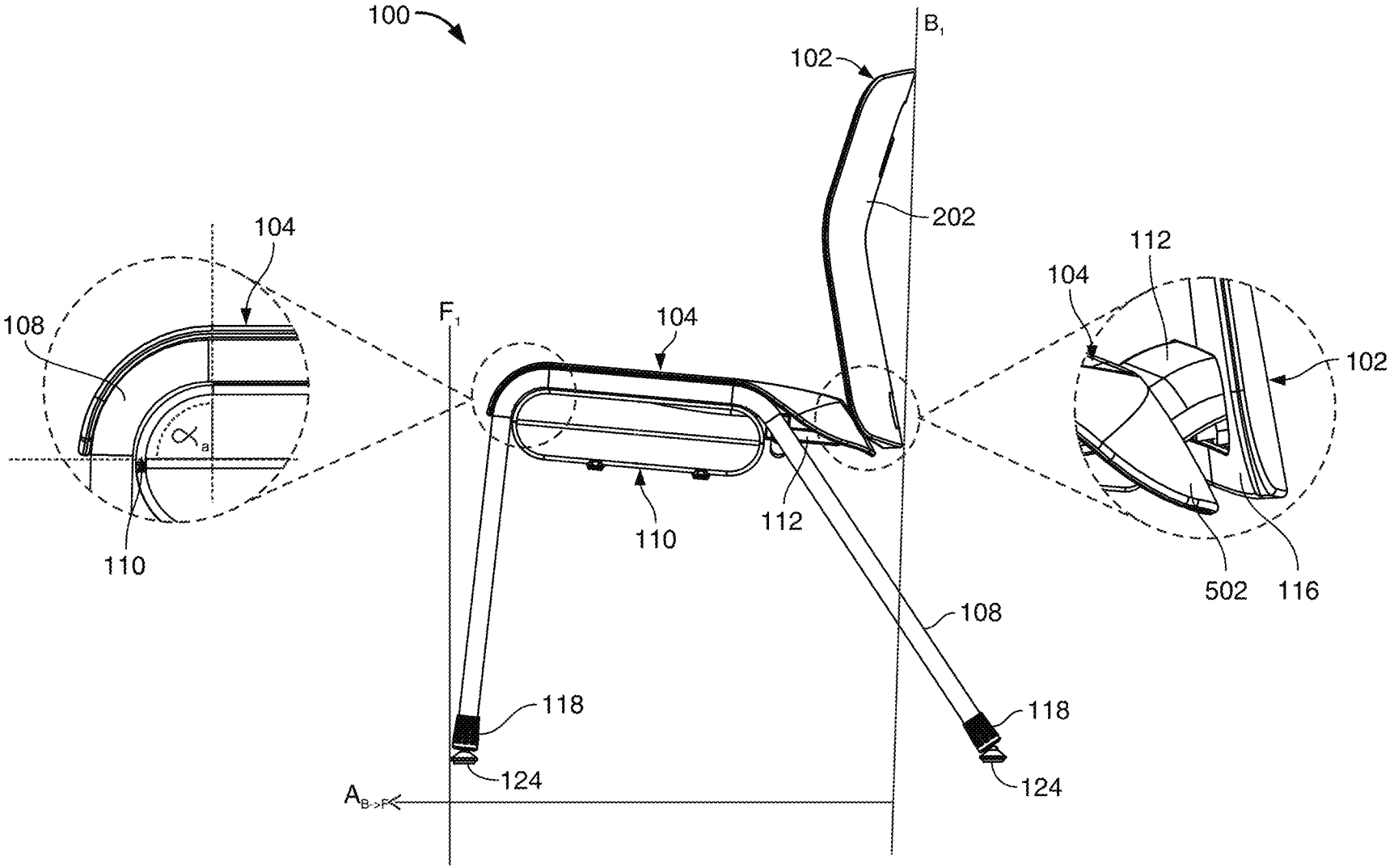
FIG. 5 shows an illustrative apparatus in accordance with principles of this matter.

FIG. 5 shows a side view of classroom chair 100.

Chair seat 104 may include a first curvature. Chair support 108 may include a second curvature. Book basket 110 may include a third curvature. The first curvature, the second curvature and the third curvature may define angle $\alpha_a$. Table 7 shows illustrative angle ranges that may include angle $\alpha_a$.

TABLE 7

| Illustrative angle ranges. Illustrative angle ranges. |
|---|
| <20° |
| 20°-40° |
| 40°-60° |
| 60°-80° |
| 80°-100° |
| >100° |
| Other suitable angle ranges |

For example, angle $\alpha_a$. may be an angle of 90°. Angle $\alpha_a$. may be an angle that is slightly larger than 90°. Angle $\alpha_a$. may be an angle that is slightly smaller than 90°. Angle $\alpha_a$ may be any suitable angle.

Chair seat 104 may include lip 502. Lip 502 may extend towards the back plane. Lip 502 may extend below a plane defined by seat pan 120. Lip 502 may include a convex surface. A bottom portion of front surface 116 may have a concave surface. The concave surface may conform to the convex surface.

Figure 6:
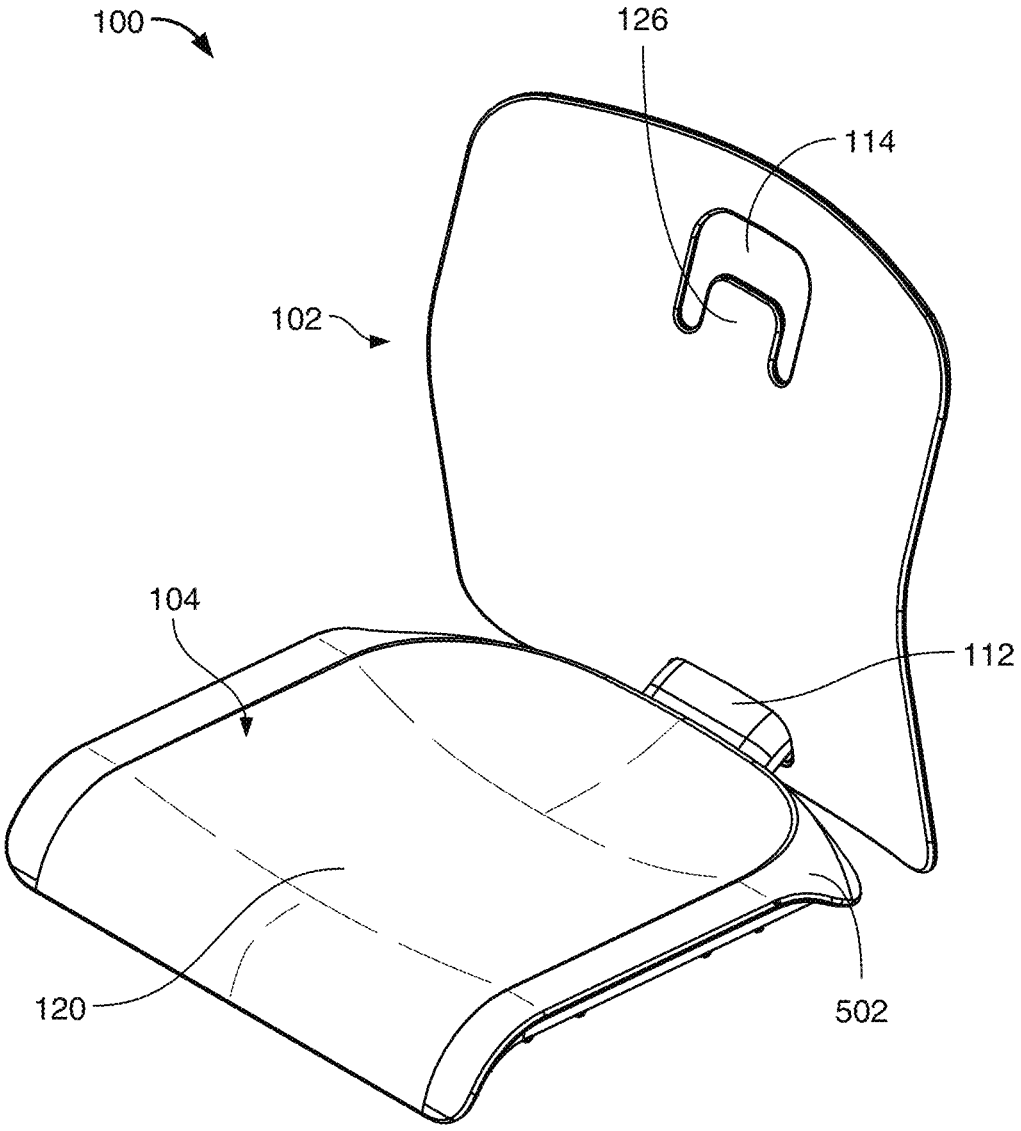
FIG. 6 shows another illustrative apparatus in accordance with principles of this matter.

FIG. 6 shows chair seat 104 coupled to chair back 102 via bracket 112.

Figure 7:
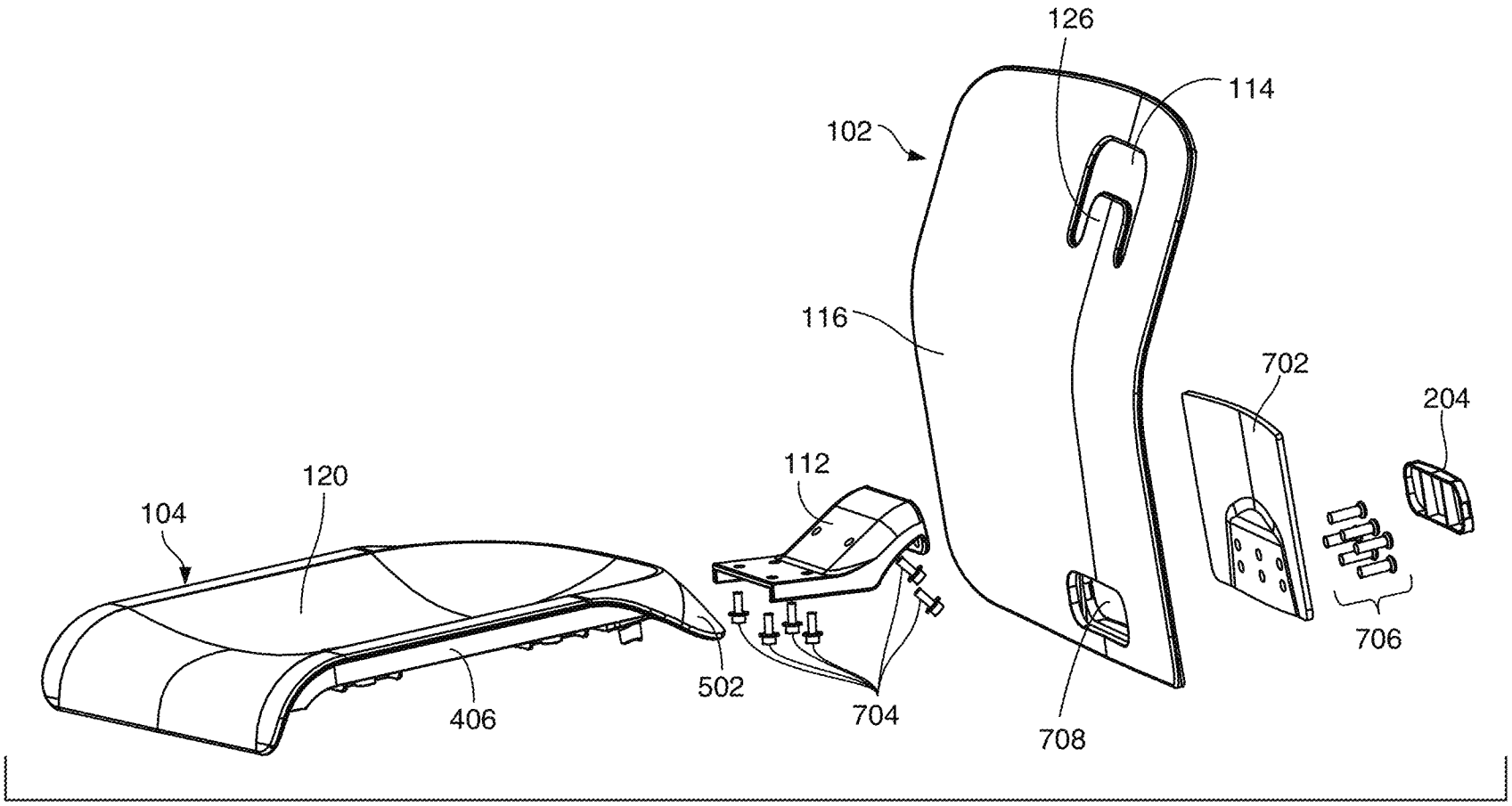
FIG. 7 shows yet another illustrative apparatus in accordance with principles of this matter.

FIG. 7 shows an exploded view of chair seat 104 coupled to chair back 102 via bracket 112.

Chair back 102 may house steel plate 702. Steel plate 702 may be attached to bracket 112 via screws 706. Cover 204 may cover screws 706 when screws 706 attach steel plate 702 to bracket 112. Bracket 112 may be attached to underside 406 of chair seat 104 via screws 704.

Chair back 102 may define cavity 708. Cavity 708 may extend through a thickness of chair back 102. Cavity 708 may expose steel plate 702 when steel plate is housed in chair back 102.

Figure 8A:
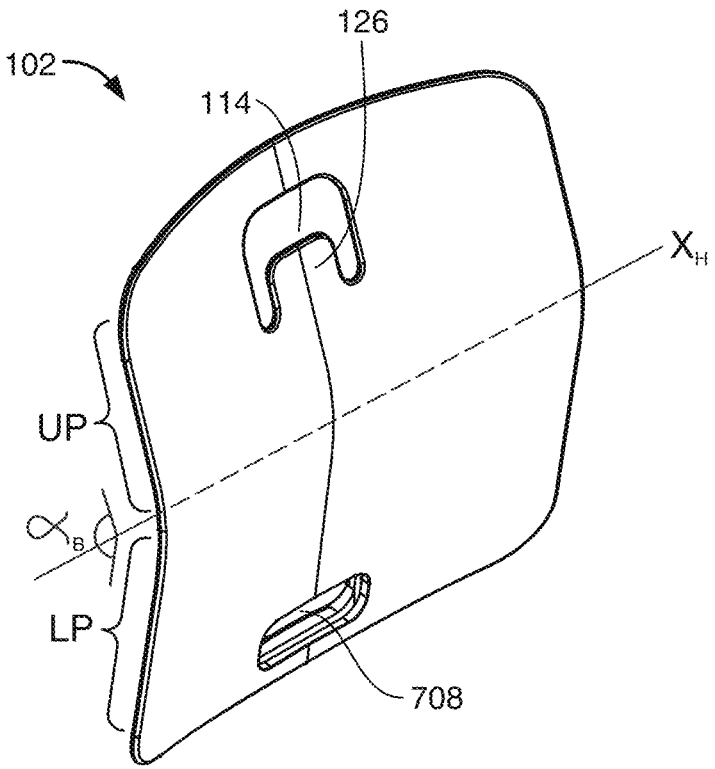
FIGS. 8A-8F show still another illustrative apparatus in accordance with principles of this matter.

FIG. 8A shows a front view of chair back 102.

Chair back 102 may define horizontal axis $X_H$. Horizontal axis $X_H$ may define upper portion UP of chair back 102. Horizontal axis $X_H$ may define lower portion LP of chair back 102. Horizontal axis $X_H$ may define a linear bend. The linear bend may separate upper portion UP from lower portion LP. The linear bend may define angle $\alpha_B$. Table 8 shows illustrative angle ranges that may include angle $\alpha_B$.

TABLE 8

| Illustrative angle ranges. Illustrative angle ranges. |
|---|
| <25° |
| 25°-50° |
| 50°-75° |
| 75°-100° |
| 100°-125° |
| 125°-150° |
| 150°-175° |
| >175° |
| Other suitable angle ranges |

For example, angle $\alpha_B$ may be an angle of 152°. Angle $\alpha_B$ may be an angle of 152.81°. Angle $\alpha_B$ may be any suitable angle.

Figure 8B:
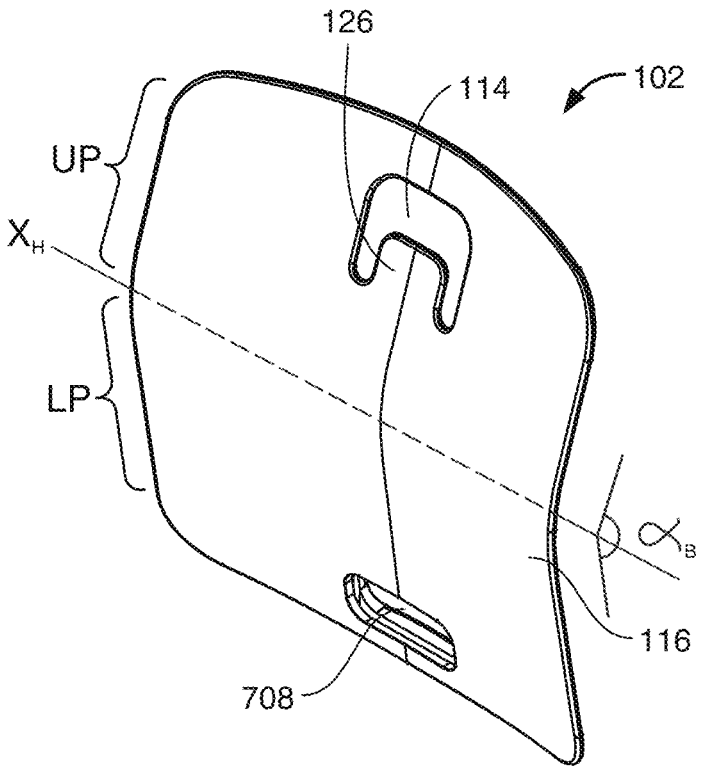

FIG. 8B shows another front view of chair back 102.

Figure 8C:
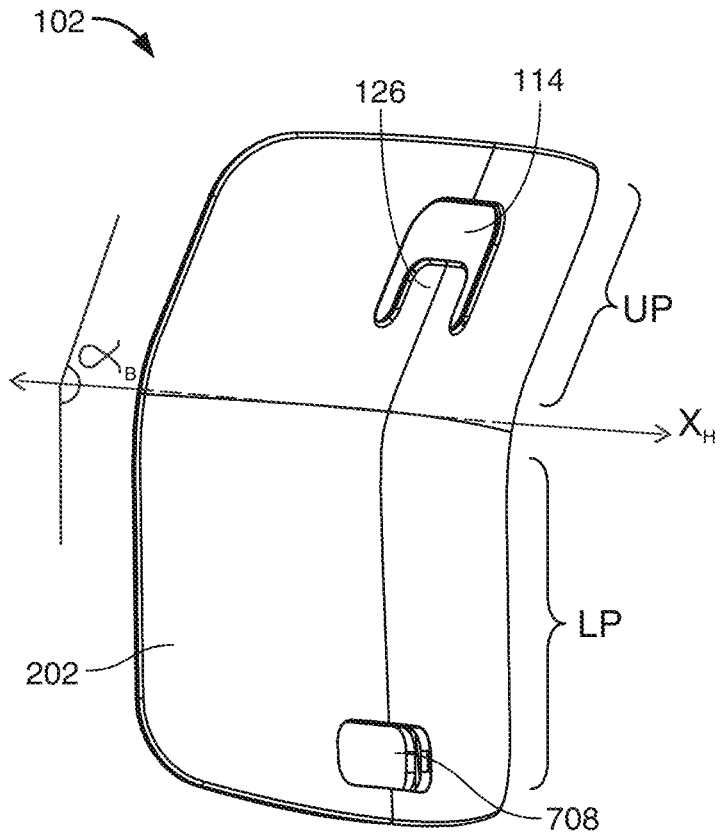

FIG. 8C shows a back view of chair back 102.

Figure 8D:
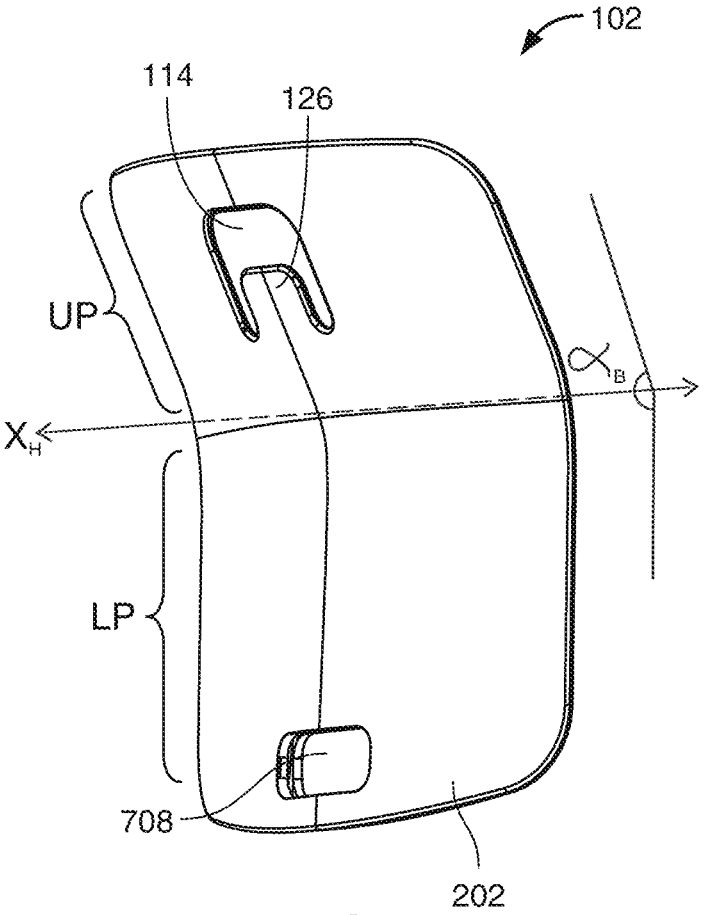

FIG. 8D shows another back view of chair back 102.

Figure 8F:
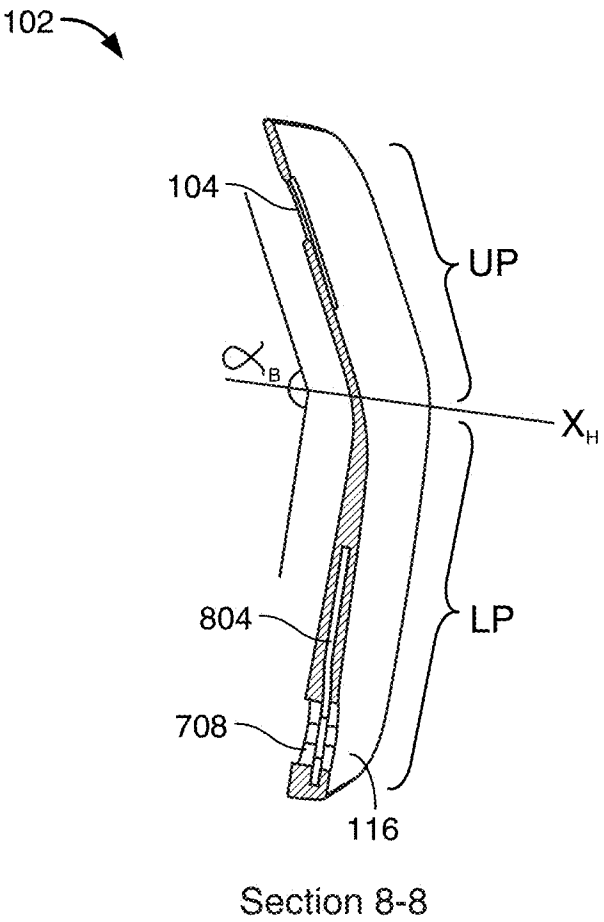
Figure 8E:
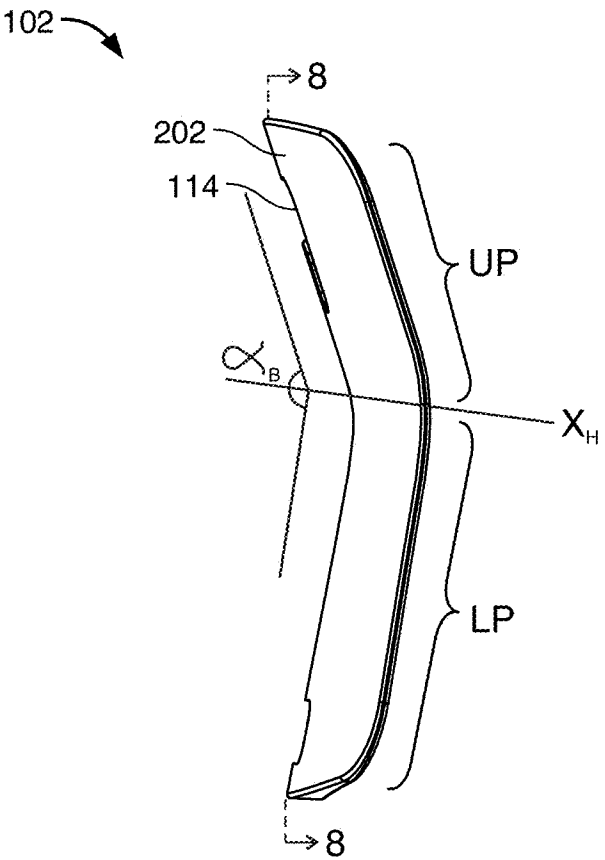

FIG. 8E shows a side view of chair back 102.

FIG. 8F shows a cross section of chair back 102 taken along view lines 8-8.

Chair back 102 may define socket 804. Socket 804 may include an open space within chair back 102. Socket 804 may house steel plate 702.

Figure 9B:
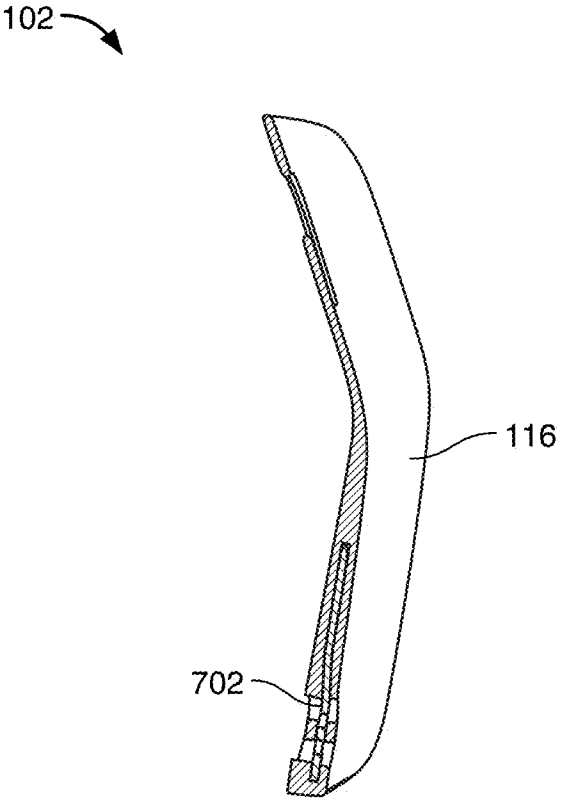
FIGS. 9A-9B show an illustrative apparatus in accordance with principles of this matter.
Figure 9A:
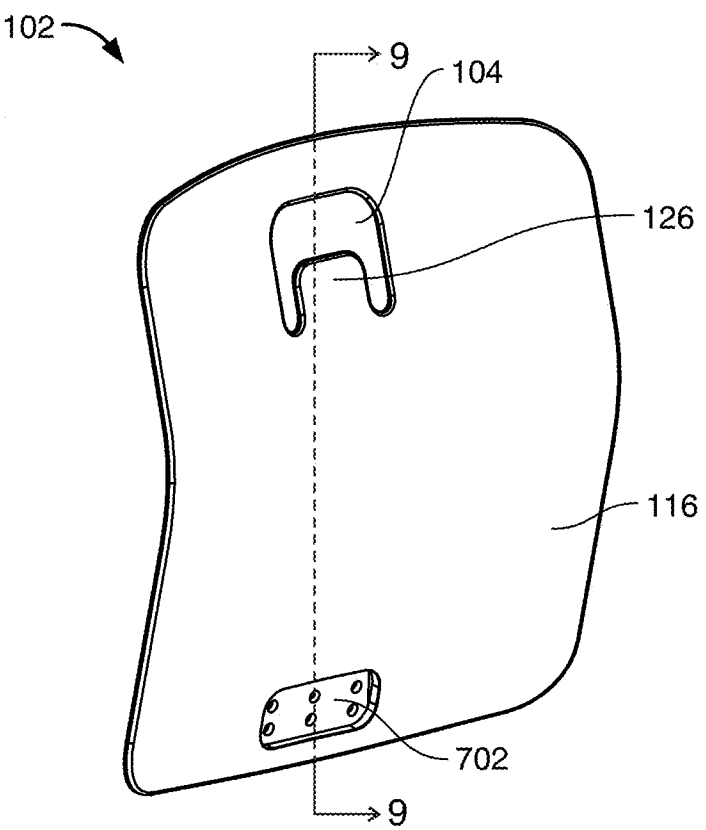

FIG. 9A shows chair back 102 with steel plate 702 housed in socket 804. When steel plate 702 is housed in socket 804, cavity 708 may expose a portion of steel plate 702.

FIG. 9B shows a cross-sectional view of chair back 102 with steel plate 702 housed in socket 804, taken along view lines 9-9.

Figure 10A:
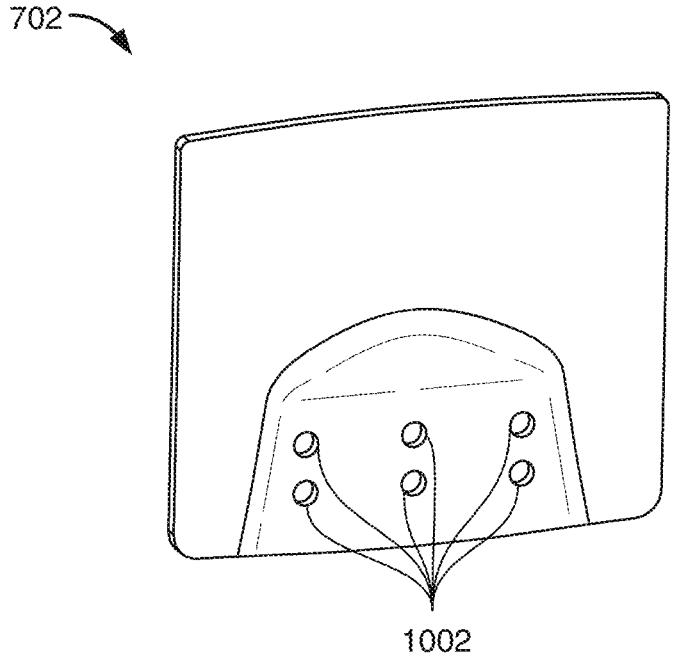
FIGS. 10A-10B show another illustrative apparatus in accordance with principles of this matter.

FIG. 10A shows a front view of steel plate 702.

Steel plate 702 may include apertures 1002. Each aperture included in apertures 1002 may receive one of screws 706. Each of apertures 1002 may receive one of screws 706 to attach steel plate 702 to bracket 112. Bracket 112 may define apertures (shown in FIGS. 12A and 12B). Each aperture defined by bracket 112 may receive one of screws 706. Each of screws 706 may have a corresponding nut. Each screw from screws 706 may be placed through an aperture included in apertures 1002 and a corresponding aperture included in bracket 112. Each nut may be used to secure a corresponding one of screws 706.

Figure 10B:
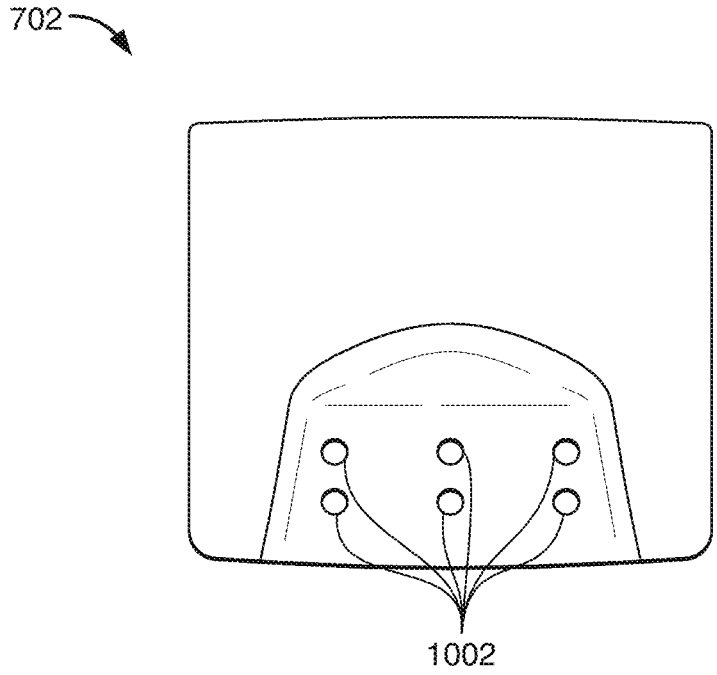

FIG. 10B shows a back view of steel plate 702.

Figure 11A:
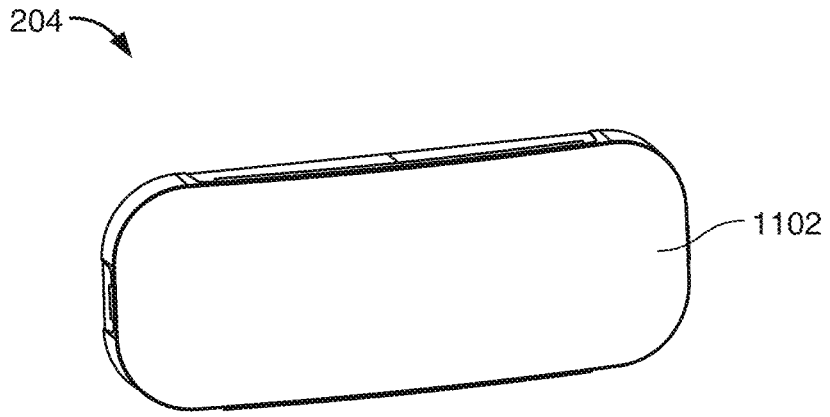
FIGS. 11A-11B show yet another illustrative apparatus in accordance with principles of this matter.

FIG. 11A shows a back view of cover 204.

Cover 204 may be a lock-tight cover. When cover 204 covers cavity 708, surface 1102 may be visible to a user.

Figure 11B:
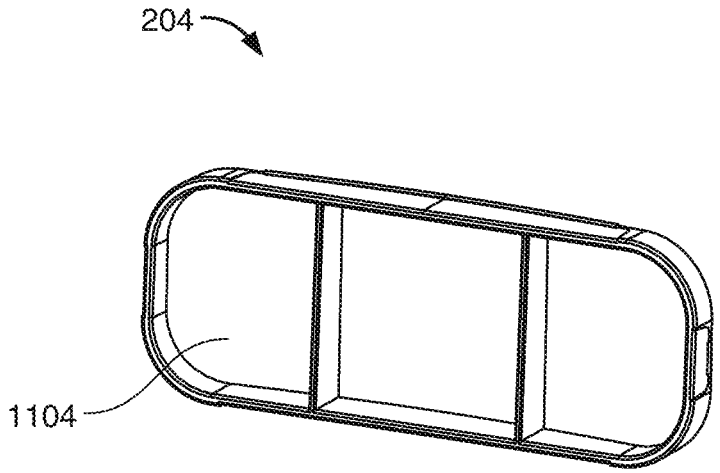

FIG. 11B shows a front view of cover 204.

When cover 204 covers cavity 708, inside 1104 may not be visible to a user.

Figure 12A:
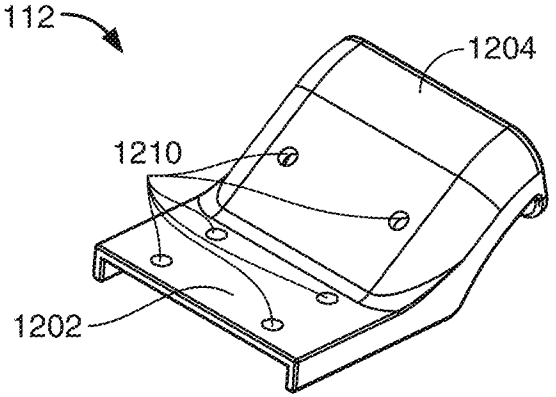
FIGS. 12A-12D show still another illustrative apparatus in accordance with principles of this matter.

FIG. 12A shows a perspective view of bracket 112.

Bracket 112 may include curved portion 1204. Bracket 112 may include flat portion 1202. Flat portion 1202 may define apertures 1210. Each of apertures 1210 may receive one of screws 704. Each of apertures 1210 may receive one of screws 704 to attach bracket 112 to underside 406 of chair seat 104. Underside 406 may define receptacles (shown in FIG. 13B). Each receptacle defined by underside 406 may receive one of screws 704. Screws 704 may be set screws. Each of screws 704 may have a tight fit in a corresponding receptacle from the receptacles defined by underside 406.

Figure 12B:
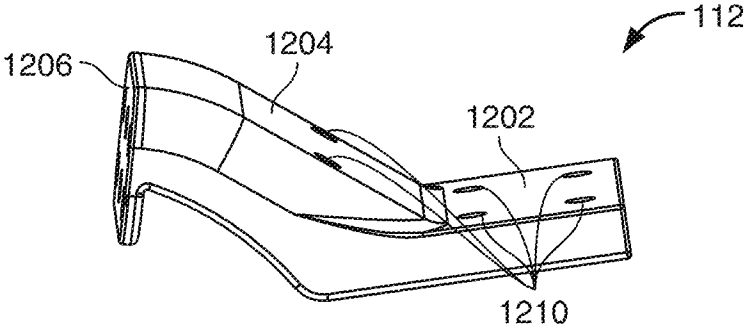

FIG. 12B shows side view of bracket 112. Bracket 112 may include back side 1206.

Figure 12C:
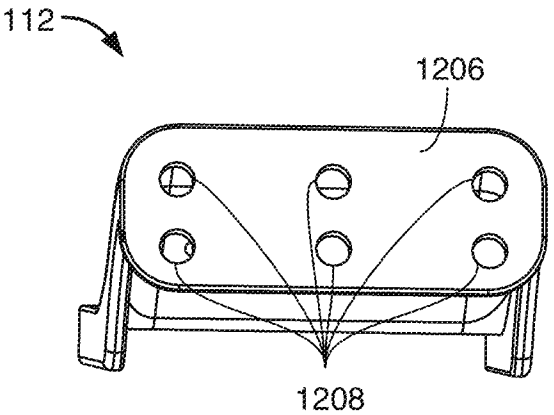

FIG. 12C shows a back view of bracket 112. Back side 1206 may define apertures 1208. Each aperture included in apertures 1208 may correspond to an aperture included in apertures 1002. Each screw from screws 706 may be placed through an aperture included in apertures 1002 and a corresponding aperture included in apertures 1208.

Figure 12D:
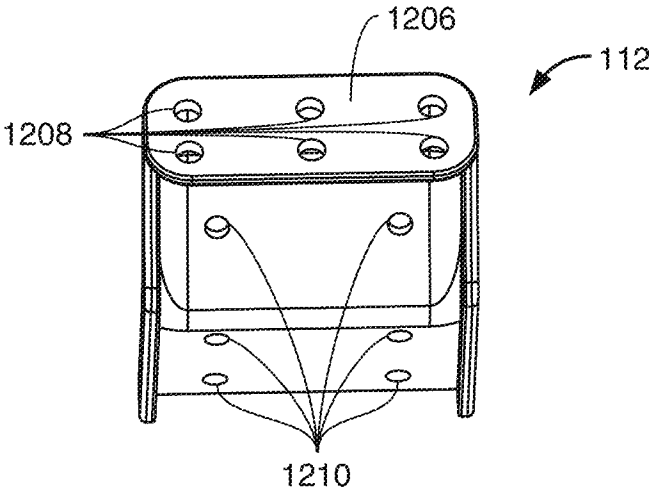

FIG. 12D shows a bottom view of bracket 112.

Figure 13C:
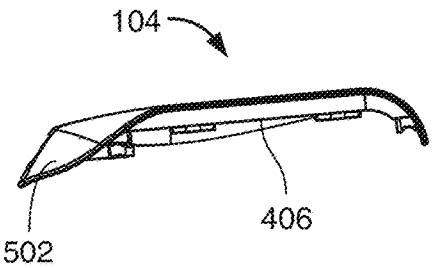
FIGS. 13A-13D show an illustrative apparatus in accordance with principles of this matter.
Figure 13B:
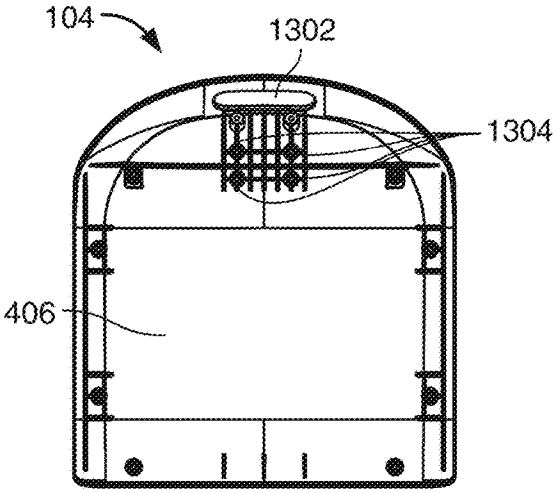
Figure 13D:
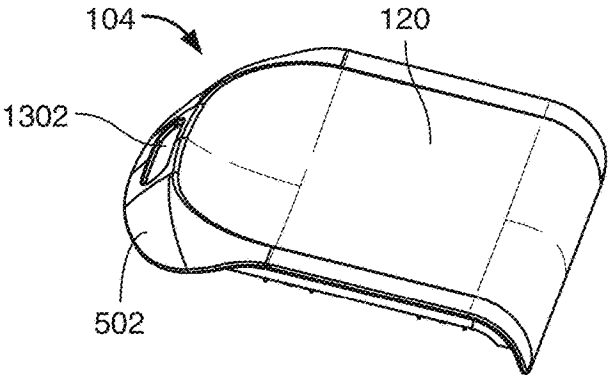
Figure 13A:
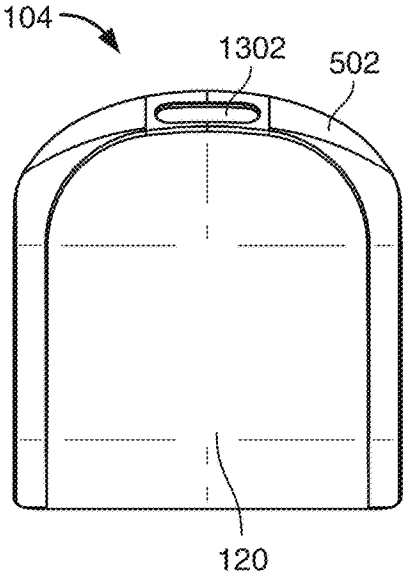

FIG. 13A shows a top view of chair seat 104.

Chair seat 104 may define aperture 1302. Bracket 112 may extend through aperture 1302. Bracket 112 may extend through aperture 1302 to connect to underside 406.

FIG. 13B shows a bottom view of chair seat 104.

Underside 406 defines receptacles 1304. Each receptacle included in receptacles 1304 may receive one of screws 704. Screws 704 may attach flat portion 1202 of bracket 112 to underside 406.

FIG. 13C shows a side view of chair seat 104.

FIG. 13D shows a perspective view of chair seat 104.

Figure 14:
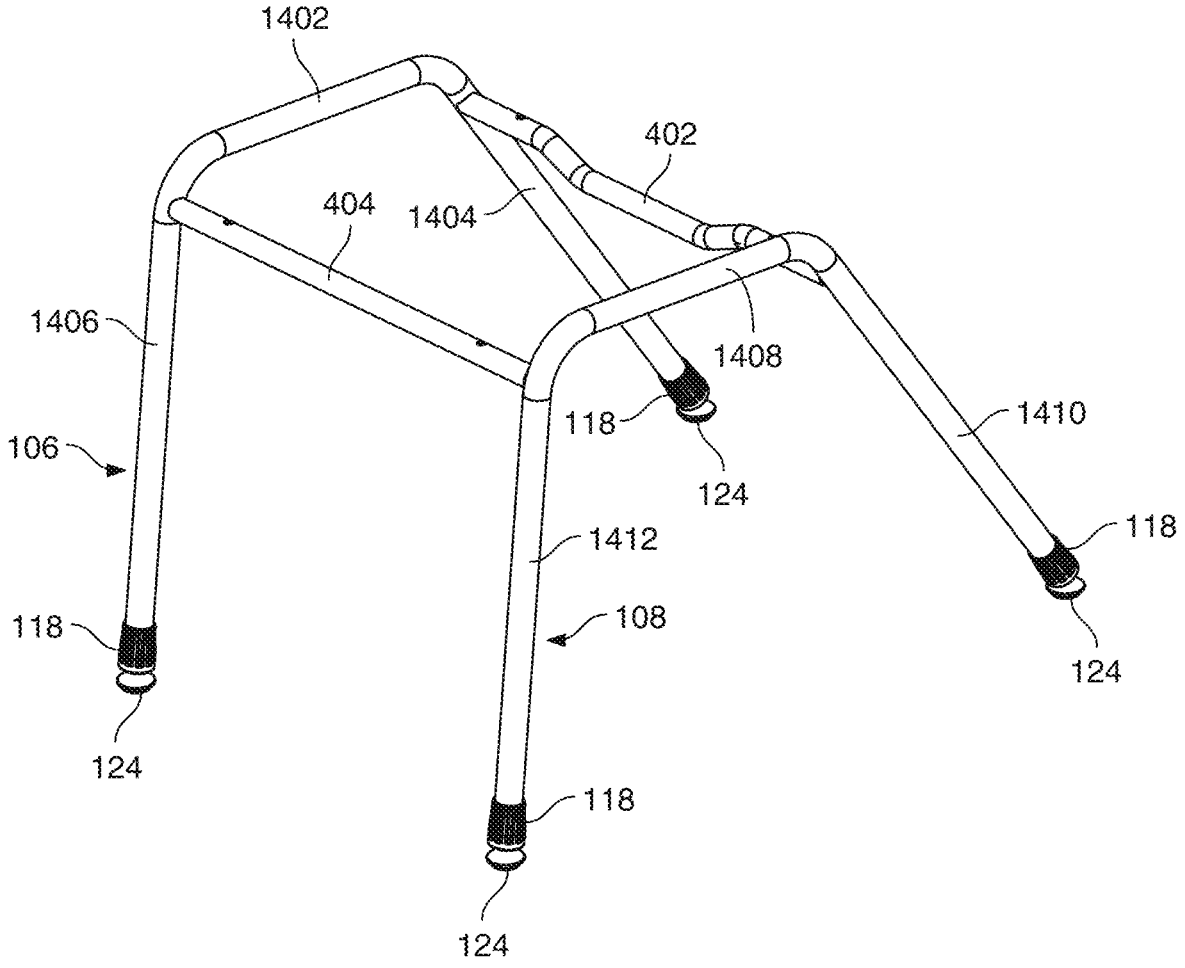
FIG. 14 shows another illustrative apparatus in accordance with principles of this matter.

FIG. 14 shows chair support 106 connected to chair support 108 via bar 402 and bar 404.

Chair support 108 may include stretcher 1408. Chair support 108 may include front leg 1412. Chair support 108 may include back leg 1410. Chair support 106 may include stretcher 1402. Chair support 106 may include front leg 1406. Chair support 106 may include back leg 1404.

Figure 15:
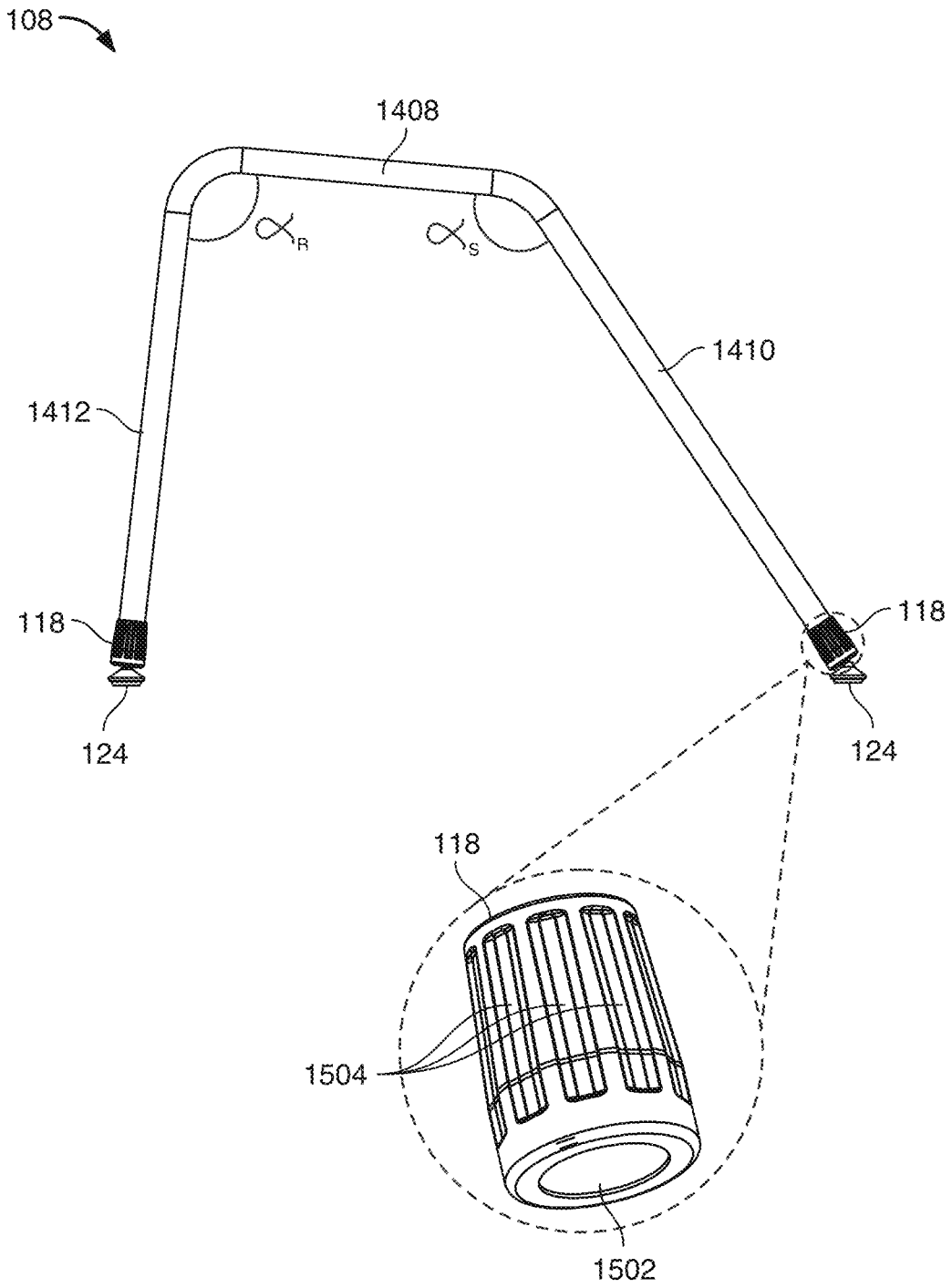
FIG. 15 shows yet another illustrative apparatus in accordance with principles of this matter.

FIG. 15 shows chair support 108. Chair support 106 may have one or more features in common with chair support 108, as described herein.

Stretcher 1408 may form angle $\alpha_R$ with front leg 1412. Stretcher 1408 may form angle $\alpha_S$ with back leg 1410. Table 9 shows illustrative angle ranges that may include angle $\alpha_R$ and angle $\alpha_S$.

TABLE 9

| Illustrative angle ranges. Illustrative angle ranges. |
|---|
| <25° |
| 25°-50° |
| 50°-75° |
| 75°-100° |
| 100°-125° |
| 125°-150° |
| 150°-175° |
| >175° |
| Other suitable angle ranges |

For example, angle $\alpha_R$ may be an angle of 91°. Angle $\alpha_R$ may be an angle of 91.34°. Angle $\alpha_R$ may be any suitable angle. Angle $\alpha_S$ may be an angle of 128°. Angle $\alpha_S$ may be an angle of 128.66°. Angle $\alpha_S$ may be any suitable angle.

Boot 118 may define bore 1502. Bore 1502 may enable boot 118 to circumscribe leg 1410. (Boot 118 may circumscribe any leg included in classroom chair 100). Boot 118 may define indents 1504.

Figure 16:
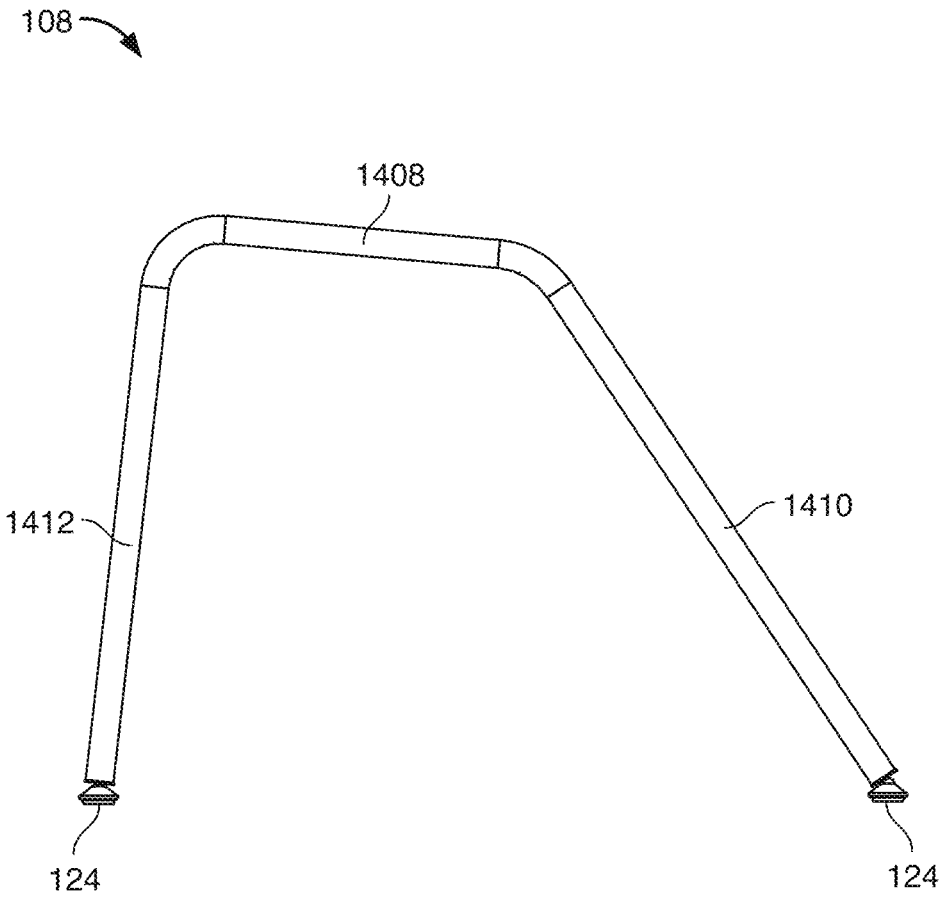
FIG. 16 shows still another illustrative apparatus in accordance with principles of this matter.

FIG. 16 shows chair support 108 without boots 118.

Figure 17A:
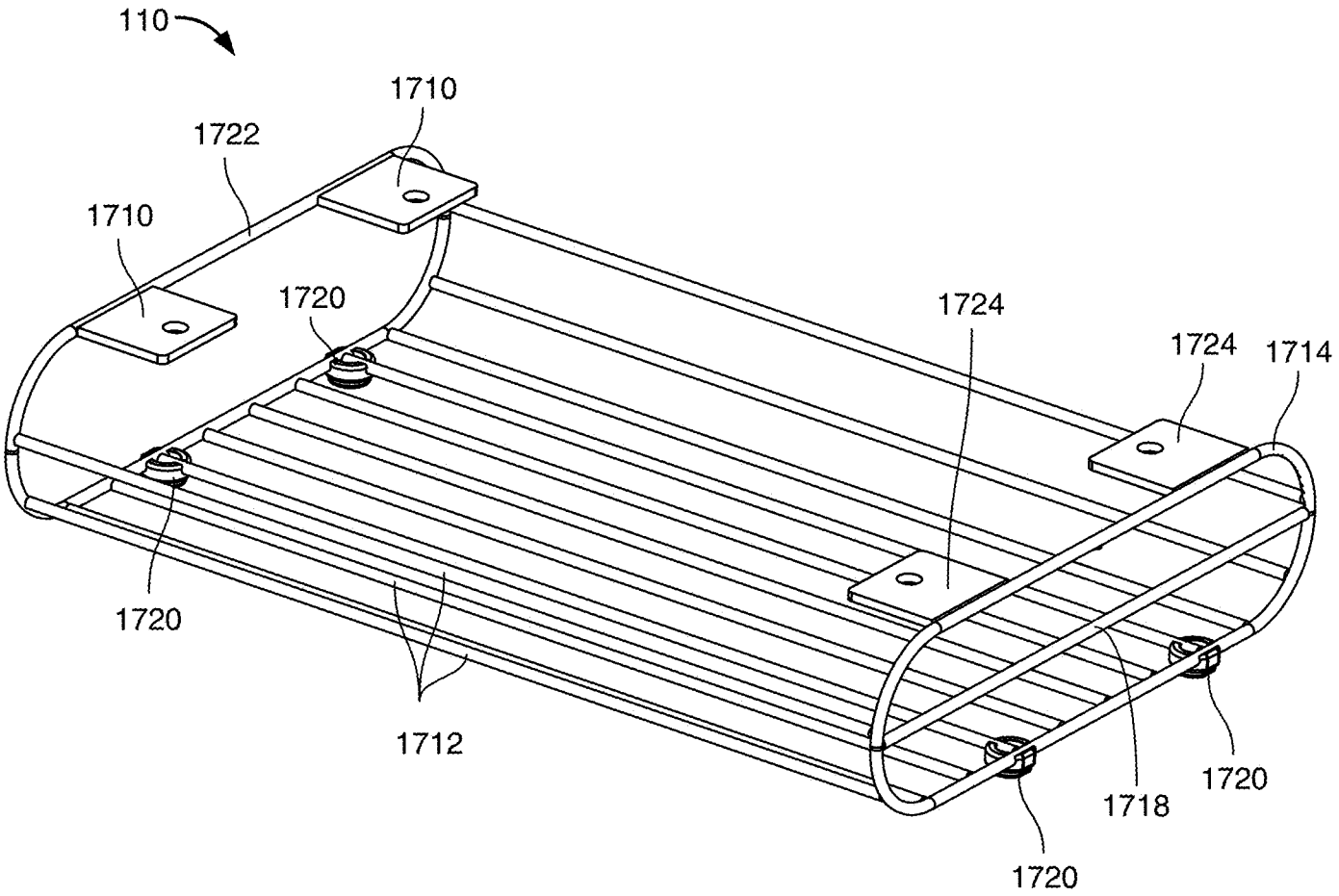
FIGS. 17A-17B show an illustrative apparatus in accordance with principles of this matter.

FIG. 17A shows book basket 110.

Book basket 110 may include frame 1714. Frame 1714 may be a stadium-shaped frame. Book basket 110 may include frame 1722. Frame 1722 may be a stadium-shaped frame. Frame 1714 may be connected to frame 1722 via plurality of connectors 1712. Plurality of connectors 1712 may be attached to frame 1714 and frame 1722 via welding, adhesives, screws and/or any other suitable method of attachment.

Mounting plates 1710 may be attached to frame 1722. Mounting plates 1710 may be attached to frame 1722 via welding, adhesives, screws and/or any other suitable method of attachment. Mounting plates 1724 may be attached to frame 1714. Mounting plates 1724 may be attached to frame 1714 via welding, adhesives, screws and/or any other suitable method of attachment. Mounting plates 1710 and mounting plates 1724 may be used to mount book basket 110 to underside 406 (not shown) of classroom chair 100 (not shown).

When frame 1714 and frame 1722 are connected via connectors 1712 and mounting plates 1710 and mounting plates 1724 are mounted to underside 406, frame 1722 may define an orifice. Frame 1722 may enable a user to insert and/or remove books and/or any suitable items into and/or out of book basket 110. Frame 1714 may include blocker 1718. Blocker 1718 may prevent any books and/or any other suitable items stored in book basket 110 from falling out of book basket 110.

Book basket 110 may include spacers 1720. Spacers 1720 may enable one classroom chair to be stacked on top of another classroom chair. Spacers 1720 may enable book basket 110 to rest on a seat pan of another classroom chair without damaging the seat pan.

Figure 17B:
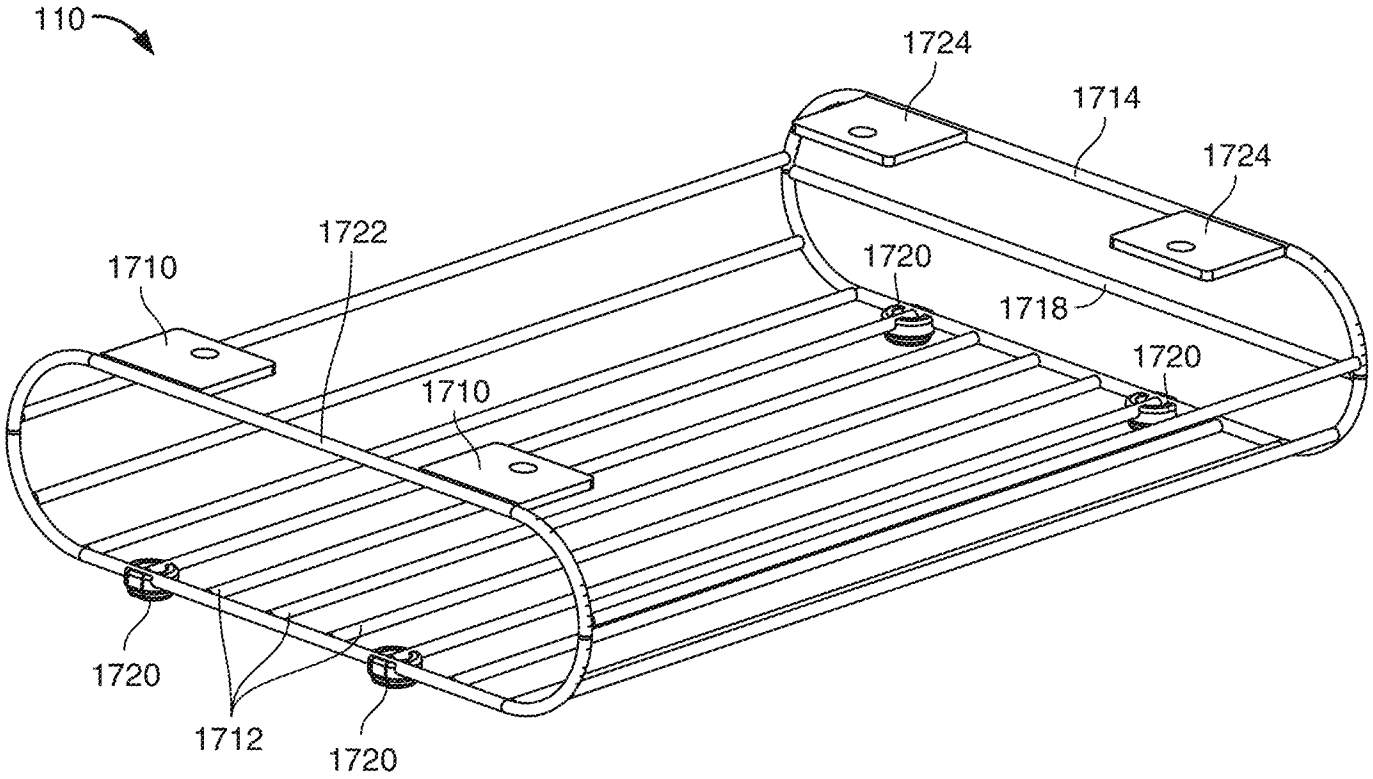

FIG. 17B shows another view of book basket 110.

Figure 18A:
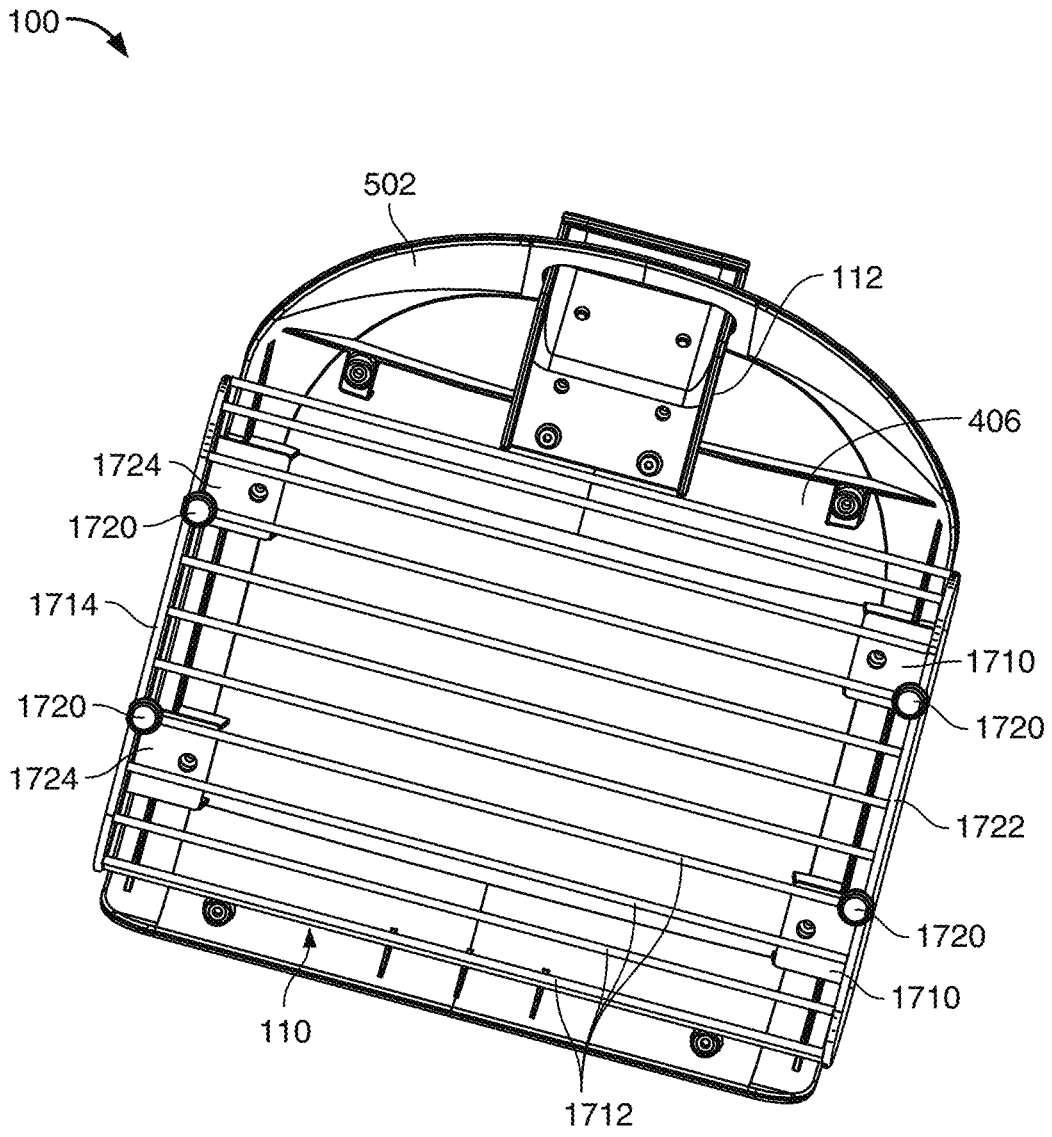
FIGS. 18A-18C show yet another illustrative apparatus in accordance with principles of this matter.

FIG. 18A shows book basket 110 mounted to underside 406 of classroom chair 100.

Book basket 110 may be mounted to underside 406 using screws (not shown). Book basket 110 may be mounted to underside 406 via welding. Book basket 110 may be mounted to underside 406 via adhesives. Book basket 110 may be mounted to underside 406 via any suitable permanent or temporary attachment mechanism.

Figure 18B:
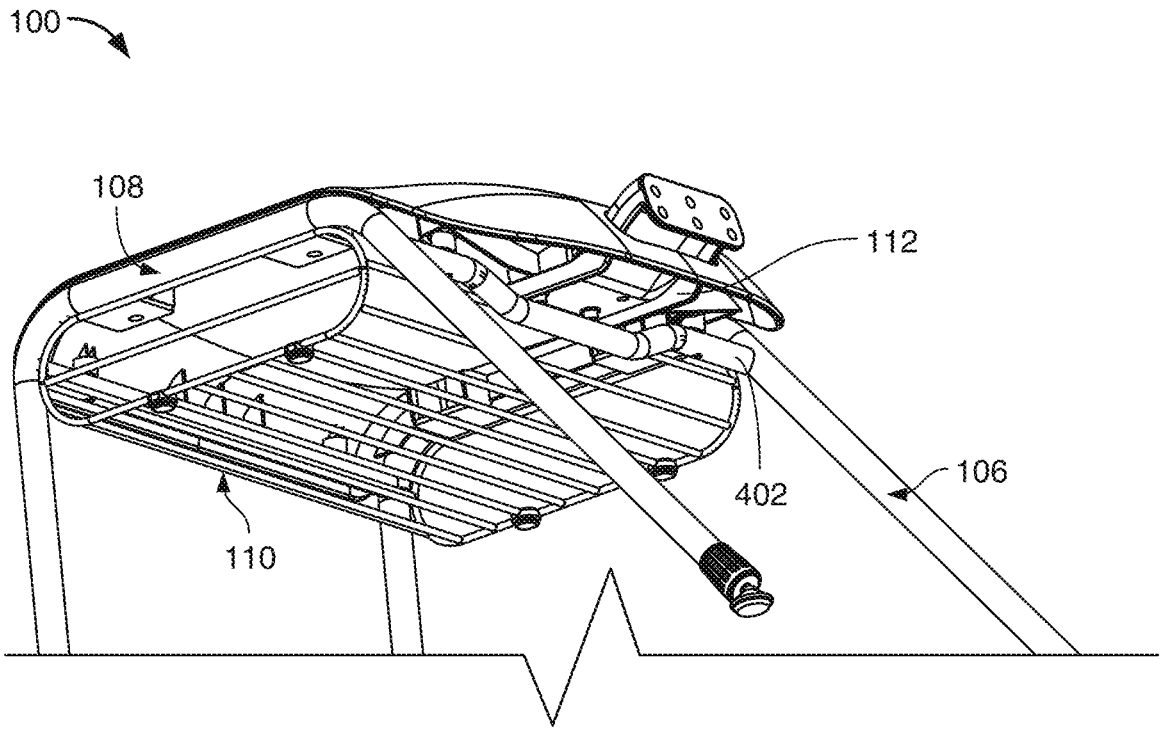

FIG. 18B shows another view of book basket 110 attached to underside 406 of classroom chair 100.

It should be noted that bar 402 may be shaped in a curved shape. As such, bar 402 may not interfere with book basket 110. Bar 402 may not interfere with book basket 110 in addition to not interfering with bracket 112. Bracket 112 may not interfere with book basket 110.

Figure 18C:
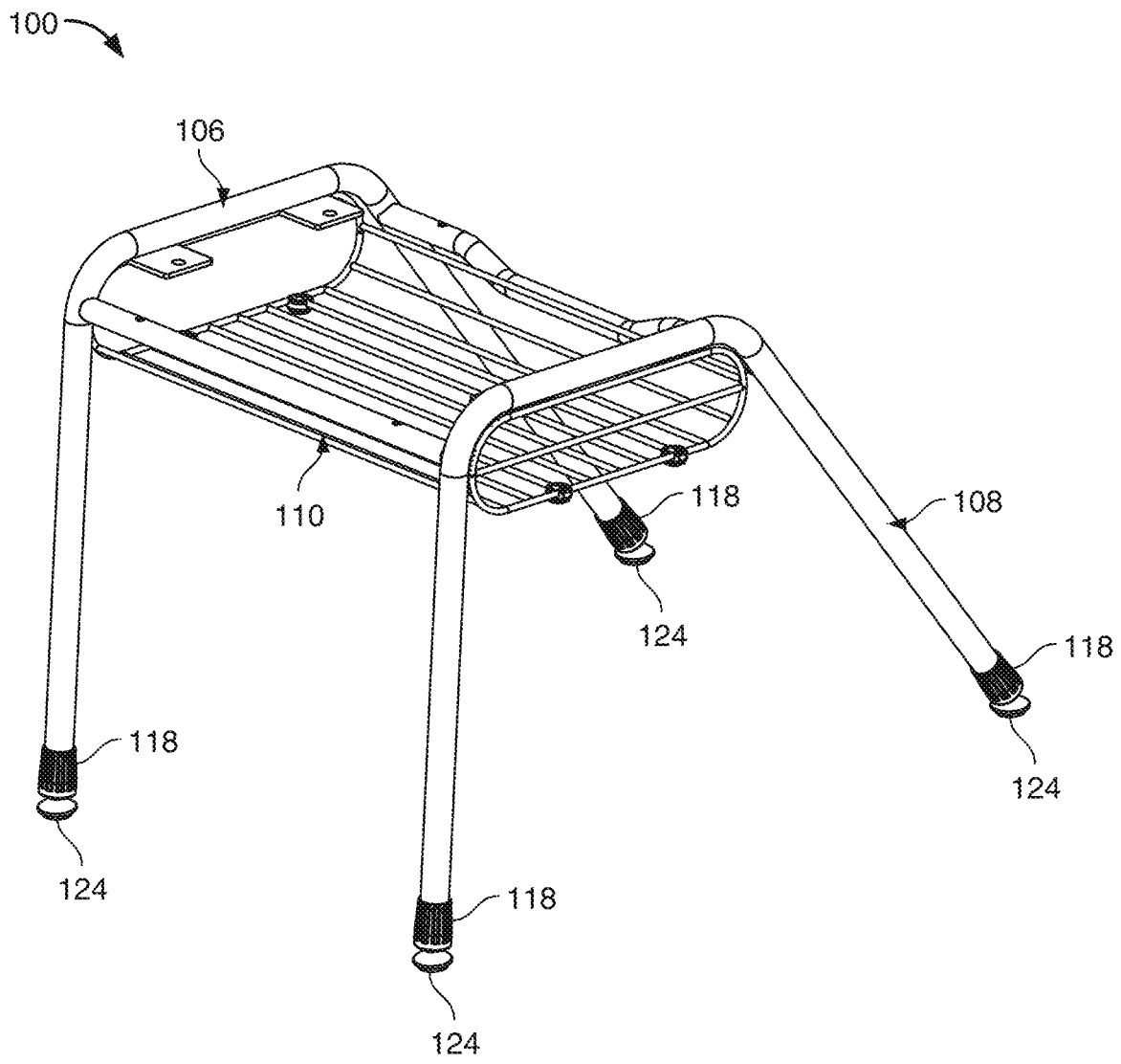

FIG. 18C shows book basket 110 flush with chair support 108 and chair support 106.

Figure 19:
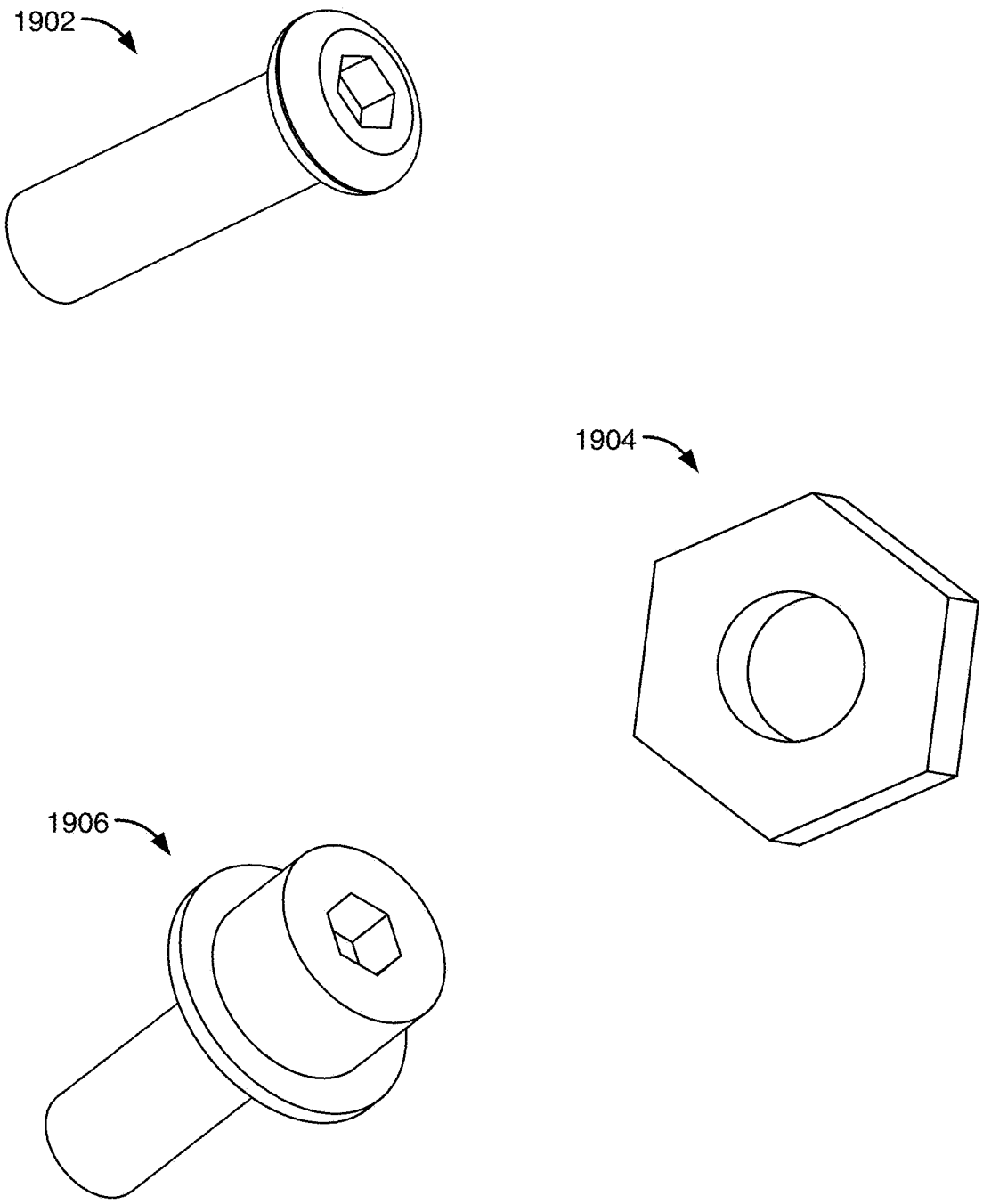
FIG. 19 shows still another illustrative apparatus in accordance with principles of this matter.

FIG. 19 shows illustrative screw components 1902, 1904 and 1906.

Screw components 1902, 1904 and 1906 may be used to connect/attach/mount different elements of classroom chair 100 as described above.

Figure 20:
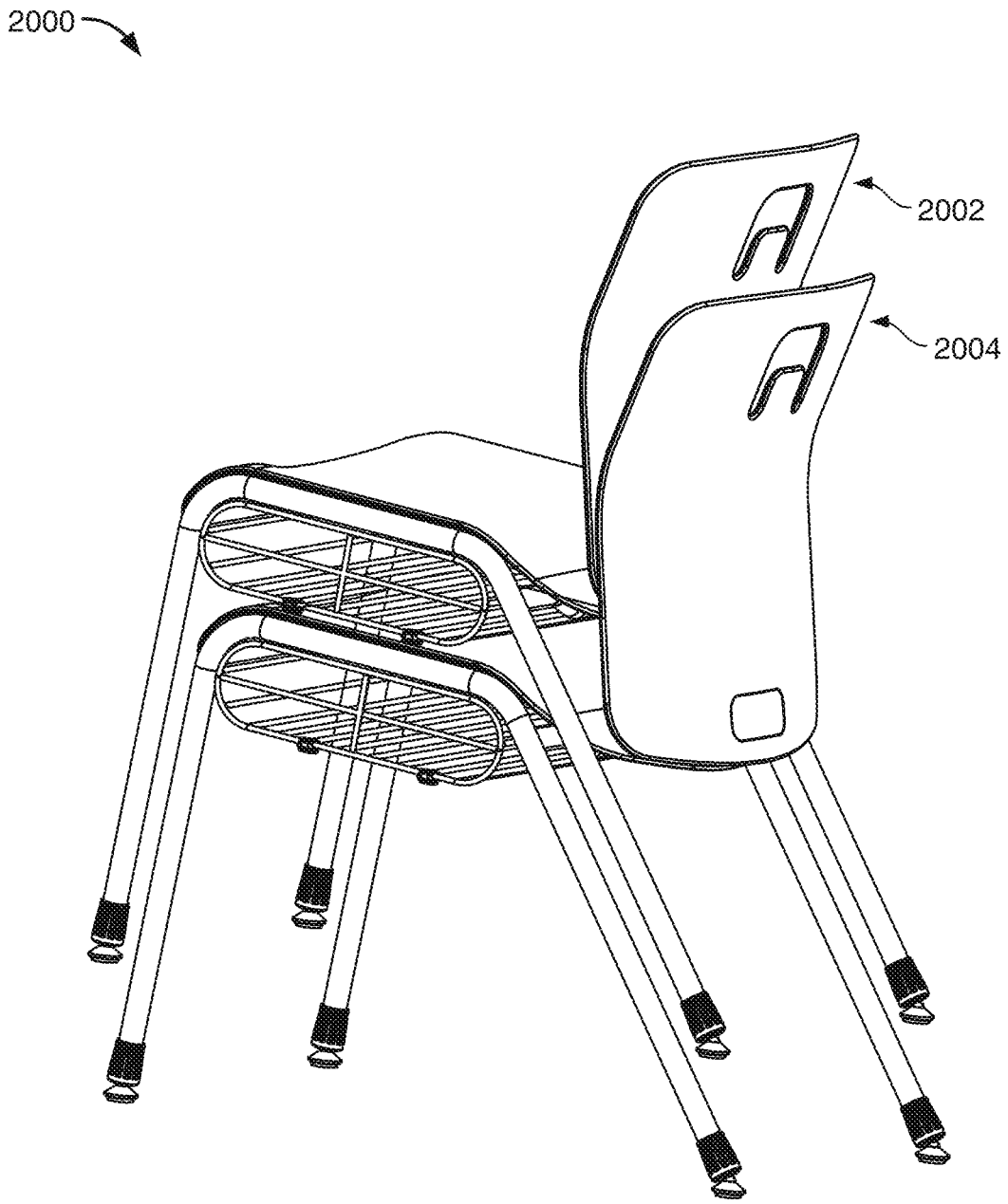
FIG. 20 shows an illustrative apparatus in accordance with principles of this matter.

FIG. 20 shows stacked classroom chairs 2000. Each of classroom chairs 2002 and 2004 may have one or more features in common with classroom chair 100.

Figure 21:
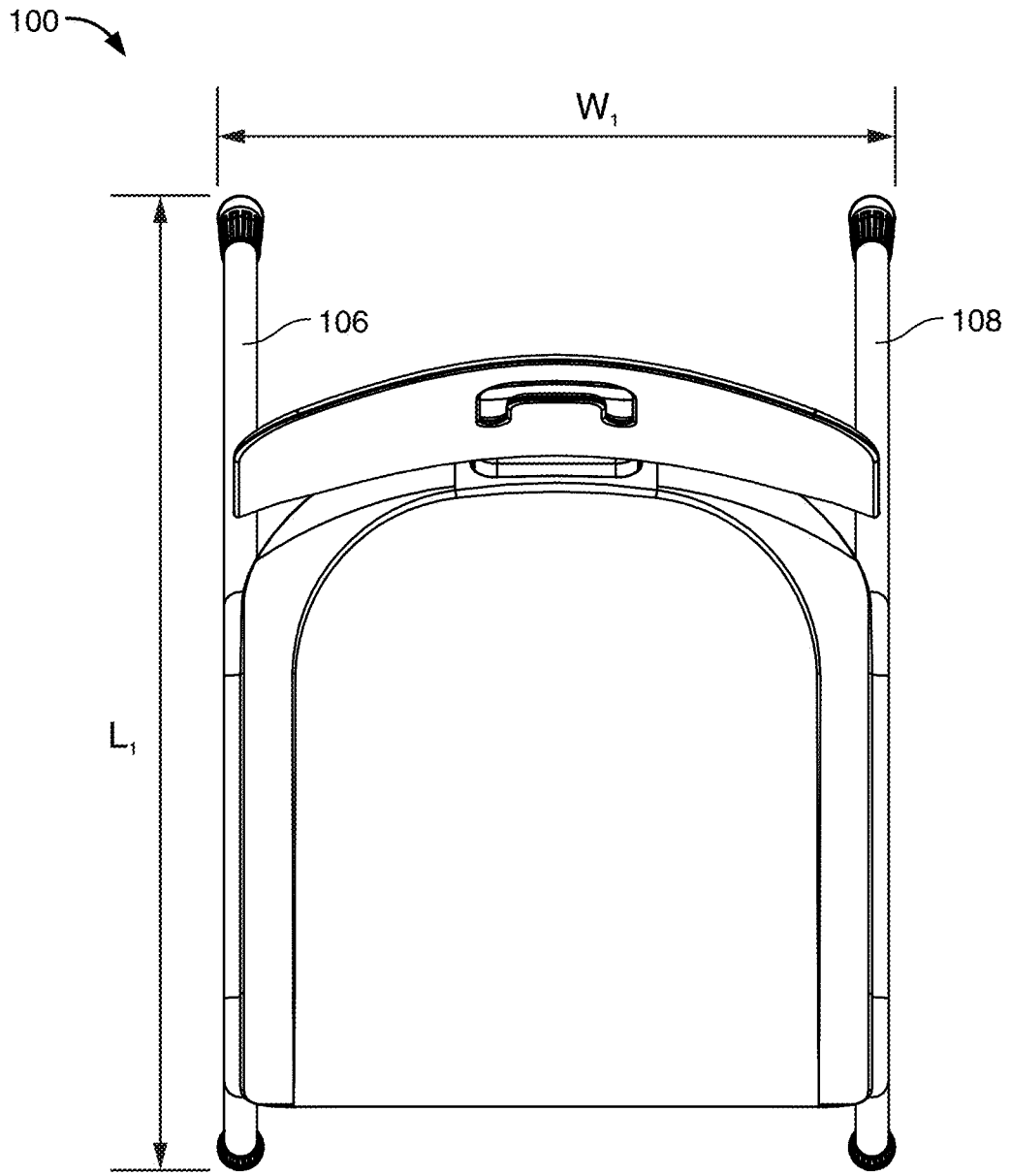
FIG. 21 shows another illustrative apparatus in accordance with principles of this matter.

FIG. 21 shows another top view of classroom chair 100. Table 10 lists the dimensions and corresponding ranges of classroom chair 100.

TABLE 10

Illustrative dimensions and corresponding ranges of classroom chair 100. Illustrative dimensions

| Dimension | Lower limit (inches ) | Upper limit (inches ) | Example (inches ) |
|---|---|---|---|
| $L_1$ | ≤10 | ≥75 | 25.50 |
| $W_1$ | ≤5 | ≥50 | 17.75 |
| Other suitable | Other suitable | Other suitable | Other suitable examples |

TABLE 10-continued

Illustrative dimensions and corresponding ranges of classroom chair 100. Illustrative dimensions

| Dimension | Lower limit (inches ) | Upper limit (inches ) | Example (inches ) |
|---|---|---|---|
| dimensions | ranges | range | |

Figure 22:
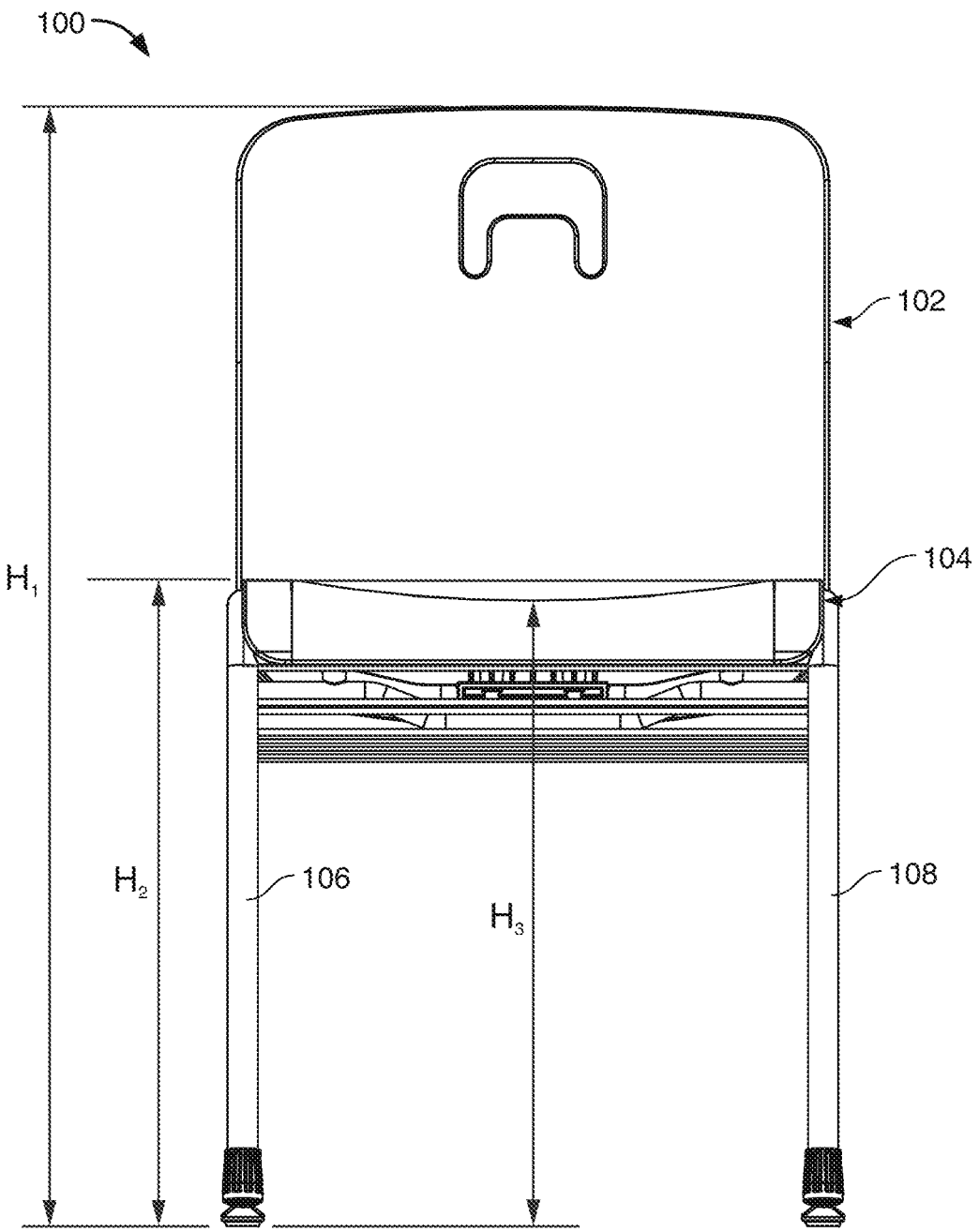
FIG. 22 shows yet another illustrative apparatus in accordance with principles of this matter.

FIG. 22 shows another front view of classroom chair 100. Table 11 lists the dimensions and corresponding ranges of classroom chair 100.

TABLE 11

Illustrative dimensions and corresponding ranges of classroom chair 100. Illustrative dimensions

| Dimension | Lower limit (inches) | Upper limit (inches ) | Example (inches) |
|---|---|---|---|
| $H_1$ | ≤2 | ≥50 | 32.00 |
| $H_2$ | ≤2 | ≥50 | 18.50 |
| $H_3$ | ≤2 | ≥50 | 17.888 |
| Other suitable dimensions | Other suitable ranges | Other suitable ranges | Other suitable examples |

Figure 23:
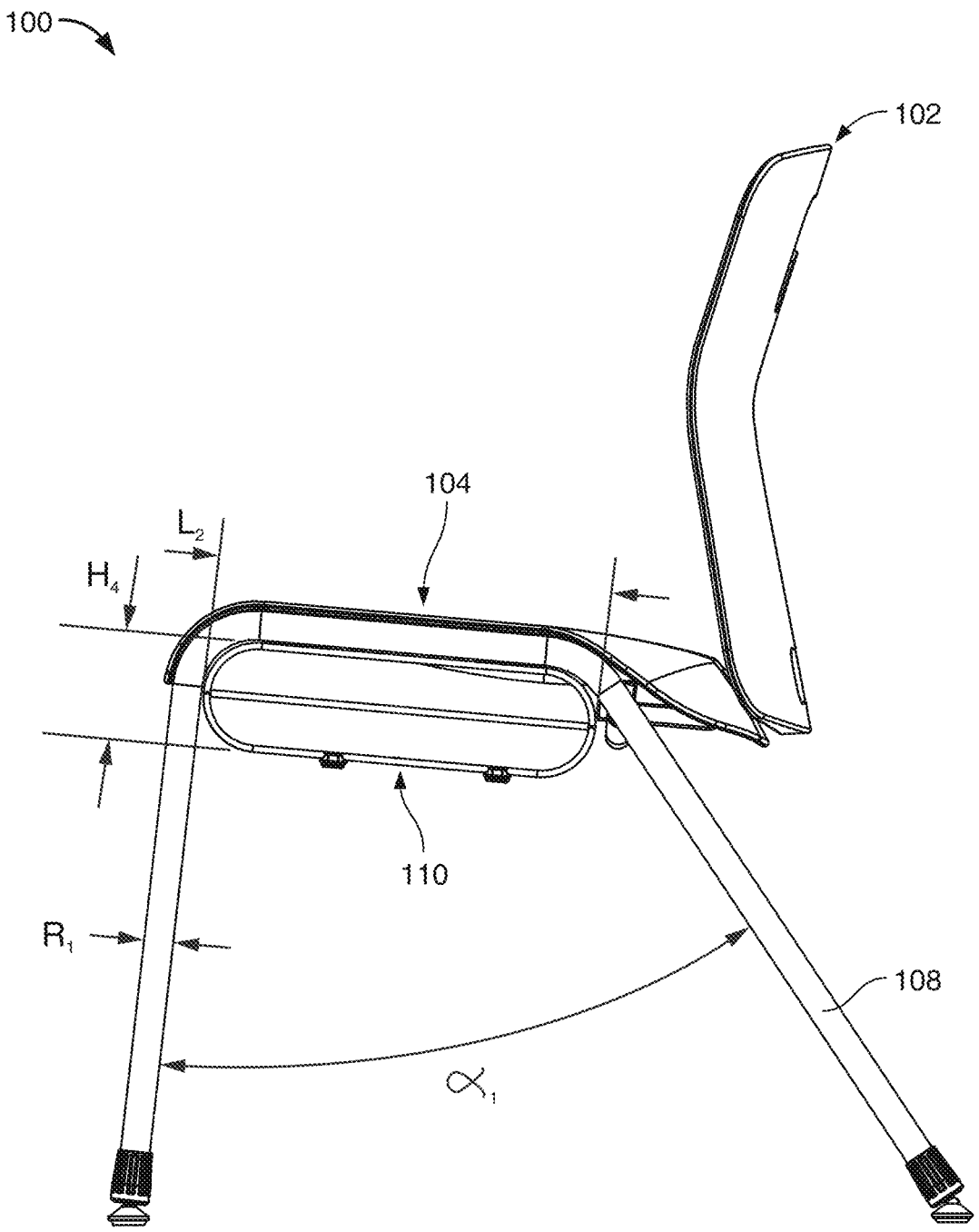
FIG. 23 shows still another illustrative apparatus in accordance with principles of this matter.

FIG. 23 shows another side view of classroom chair 100. Table 12 lists the dimensions and corresponding ranges of classroom chair 100.

TABLE 12

Illustrative dimensions and corresponding ranges of classroom chair 100. Illustrative dimensions

| Dimension | Lower limit (inches ) | Upper limit (inches) | Example (inches) |
|---|---|---|---|
| $H_4$ | ≤1 | ≥15 | 3.247 |
| $L_2$ | ≤1 | ≥25 | 11.654 |
| $R_1$ | ≤.05 | ≥5 | 0.866 |
| $\alpha_1$ | ≤1° | ≥90° | 40° |
| Other suitable dimensions | Other suitable ranges | Other suitable ranges | Other suitable examples |

Figure 24A:
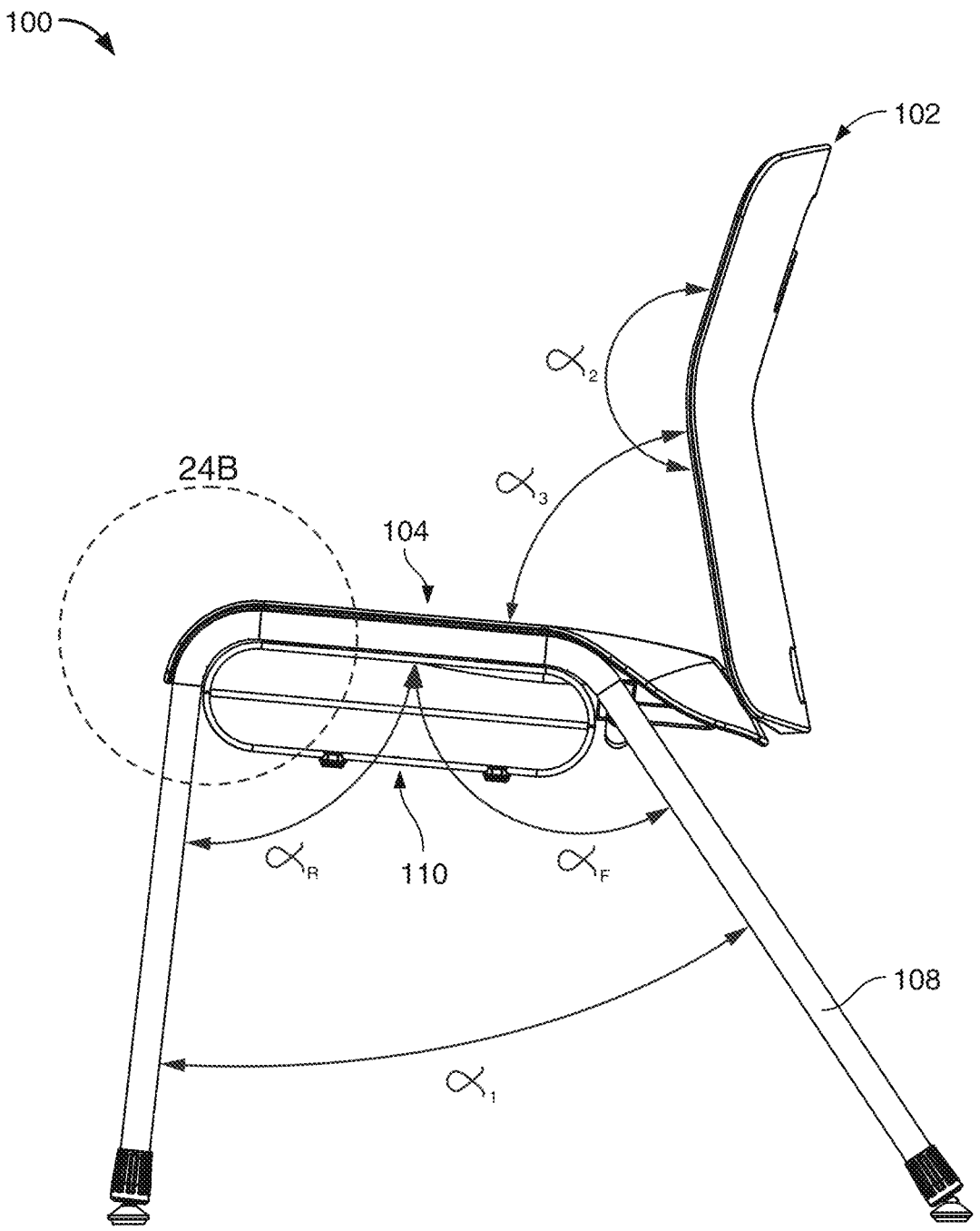
FIG. 24A-24B shows an illustrative apparatus in accordance with principles of this matter.

FIG. 24A shows another side view of classroom chair 100. Table 13 lists the dimensions and corresponding ranges of classroom chair 100.

TABLE 13

Illustrative dimensions and corresponding ranges of classroom chair 100. Illustrative dimensions

| Dimension | Lower limit (degrees) | Upper limit (degrees ) | Example (degrees) |
|---|---|---|---|
| $\alpha_1$ | ≤ any value as listed in table 13 | any value as listed in table 13 | 40 |
| $\alpha_2$ | ≤45 | ≥360 | 207.19 |
| $\alpha_3$ | ≤15 | ≥175 | 75.6 |
| $\alpha_R$ | ≤ any value as listed in table 9 | ≥ any value as listed in table 9 | 91.34 |

TABLE 13-continued

| Illustrative dimensions and corresponding ranges of classroom chair 100. Illustrative dimensions | | | |
|---|---|---|---|
| Dimension | Lower limit (degrees) | Upper limit (degrees ) | Example (degrees) |
| $\alpha_S$ | ≤ any value as listed in table 9 | ≥ any value as listed in table 9 | 128.66 |
| Other suitable dimensions | Other suitable ranges | Other suitable ranges | Other suitable examples |

Figure 24B:
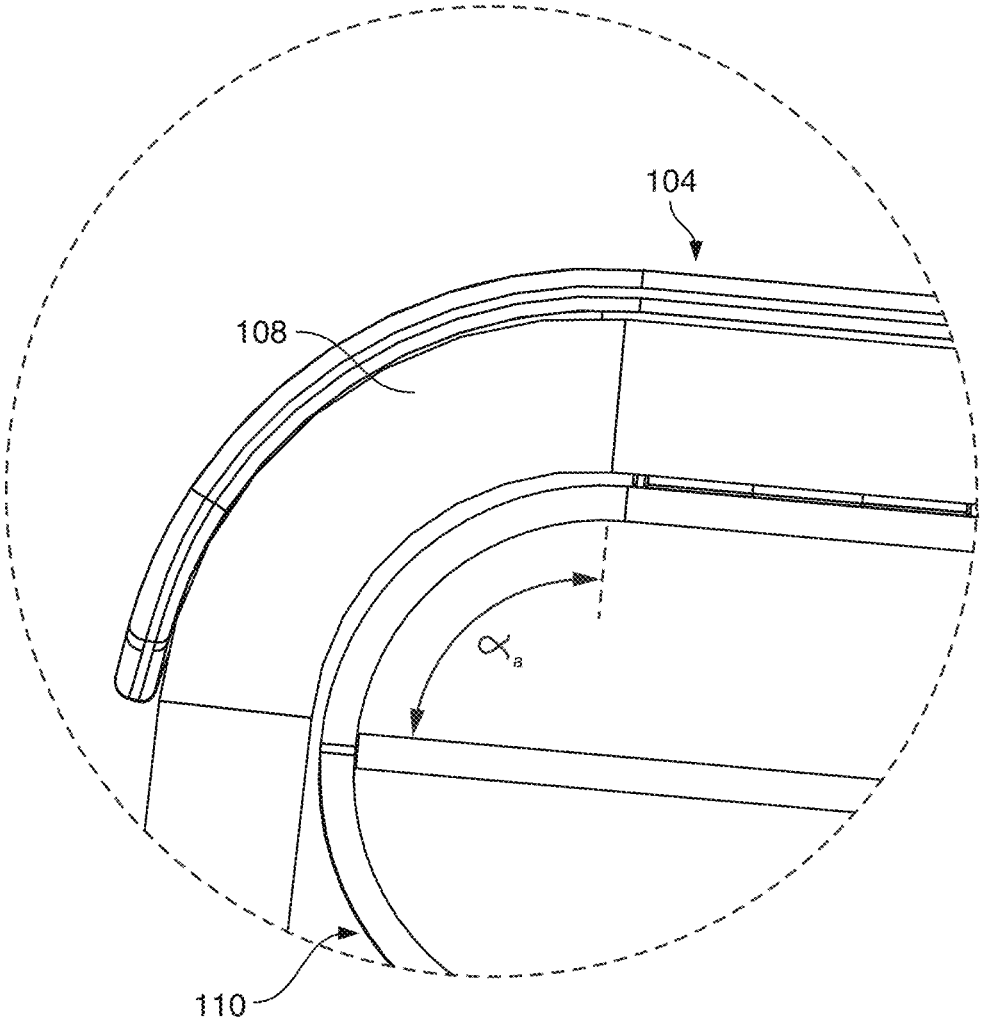

FIG. 24B shows section A taken from side view of classroom chair 100. Table 14 lists the dimensions and corresponding ranges of classroom chair 100.

TABLE 14

| Illustrative dimensions and corresponding ranges of classroom chair 100. Illustrative dimensions | | | |
|---|---|---|---|
| Dimension | Lower limit (degrees) | Upper limit (degrees ) | Example (degrees) |
| $\alpha_a$ | ≤ any value as listed in table 7 | any value as listed in table 7 | 90 |
| Other suitable dimensions | Other suitable ranges | Other suitable ranges | Other suitable examples |

Figure 25:
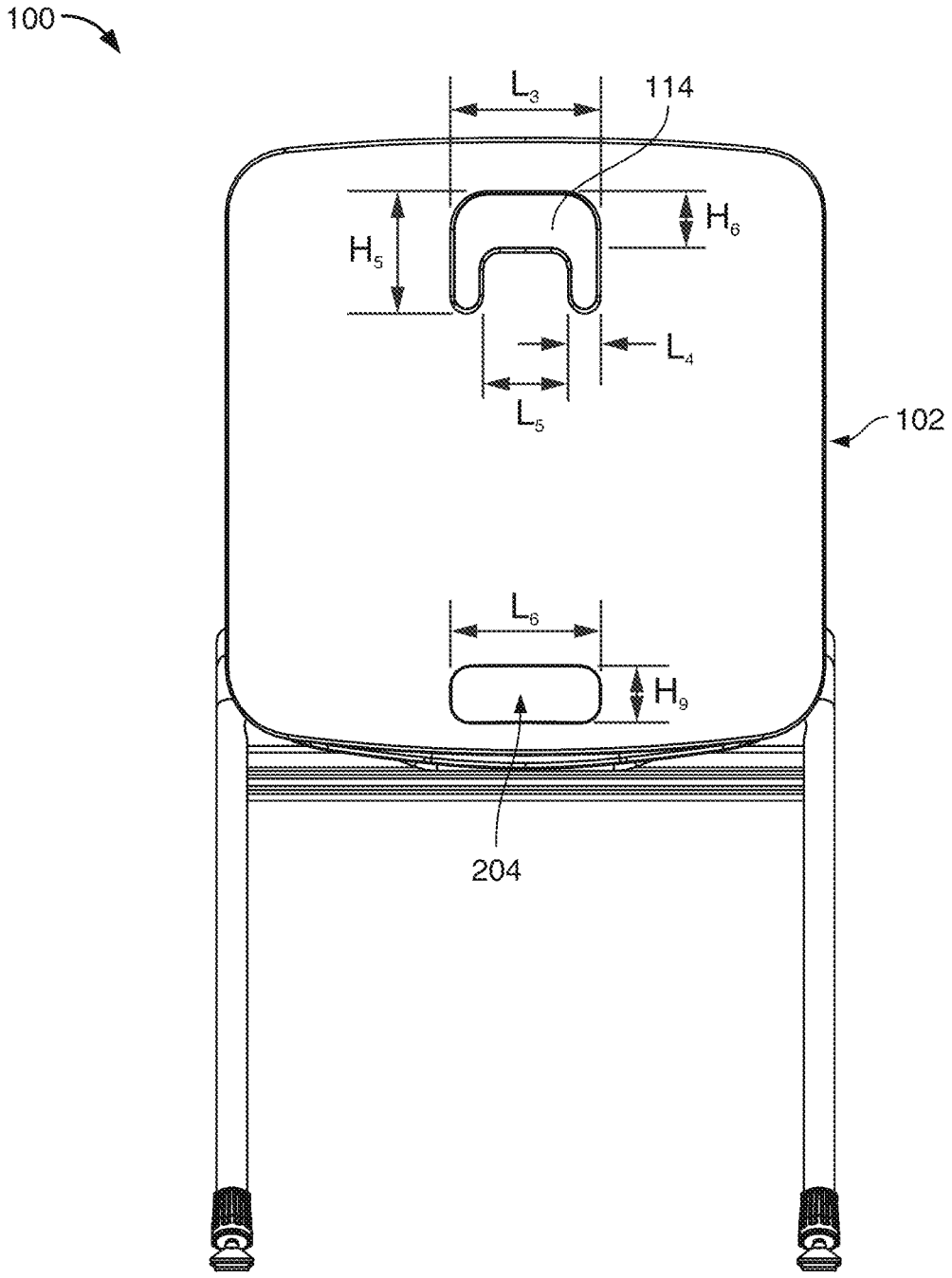
FIG. 25 shows another illustrative apparatus in accordance with principles of this matter.

FIG. 25 shows another back view of classroom chair 100. Table 15 lists the dimensions and corresponding ranges of classroom chair 100.

TABLE 15

| Illustrative dimensions and corresponding ranges of classroom chair 100. Illustrative dimensions | | | |
|---|---|---|---|
| Dimension | Lower limit (inches ) | Upper limit (inches) | Example (inches) |
| $H_5$ | ≤1 | ≥15 | 3.461 |
| $H_6$ | ≤.05 | ≥10 | 1.733 |
| $H_7$ | ≤.05 | ≥10 | 1.643 |
| $L_3$ | ≤1 | ≥15 | 4.248 |
| $L_4$ | ≤.025 | ≥10 | 0.925 |
| $L_5$ | ≤1 | ≥10 | 2.397 |
| $L_6$ | ≤1 | ≥15 | 4.266 |
| Other suitable dimensions | Other suitable ranges | Other suitable ranges | Other suitable examples |

Figure 26:
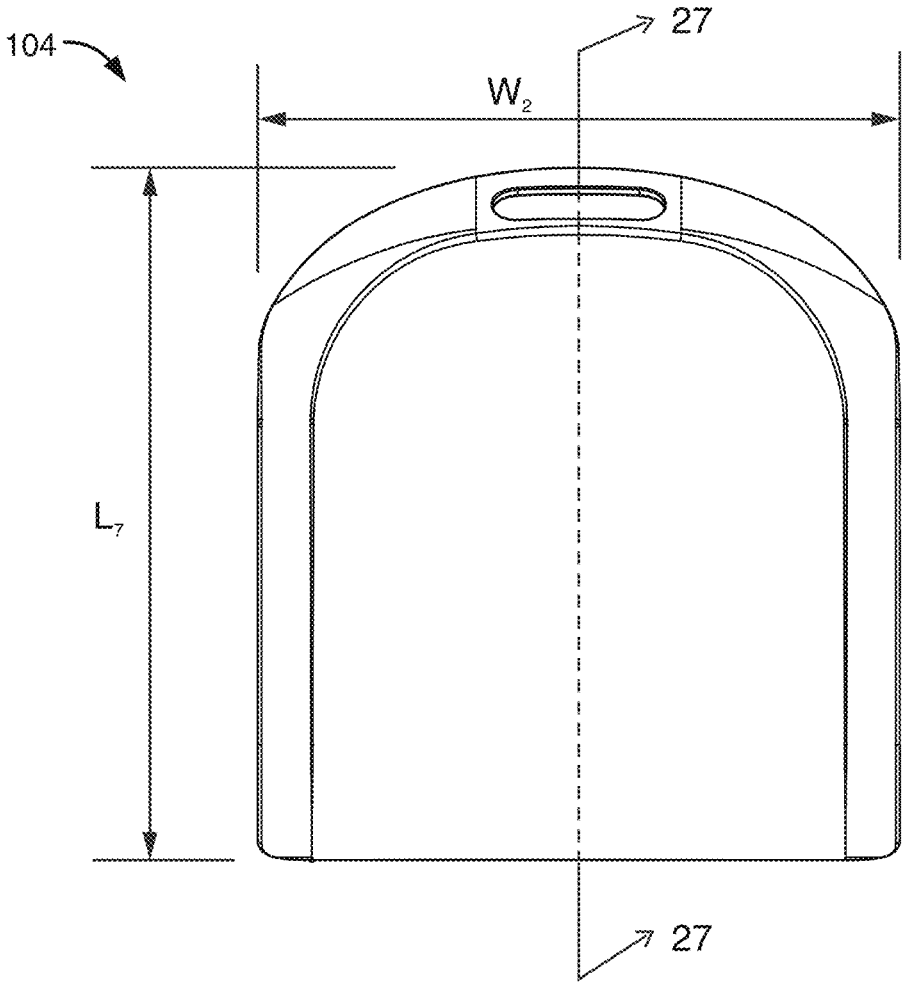
FIG. 26 shows yet another illustrative apparatus in accordance with principles of this matter.

FIG. 26 shows another view of chair seat 104. Table 16 lists the dimensions and corresponding ranges of chair seat 104.

TABLE 16

| Illustrative dimensions and corresponding ranges of chair seat 104. Illustrative dimensions | | | |
|---|---|---|---|
| Dimension | Lower limit (inches ) | Upper limit (inches ) | Example (inches) |
| $W_2$ | ≤5 | ≥50 | 16.586 |

TABLE 16-continued

| Illustrative dimensions and corresponding ranges of chair seat 104. Illustrative dimensions | | | |
|---|---|---|---|
| Dimension | Lower limit (inches ) | Upper limit (inches ) | Example (inches) |
| $L_7$ | ≤5 | ≥50 | 17.896 |
| Other suitable dimensions | Other suitable ranges | Other suitable ranges | Other suitable examples |

Figure 27:
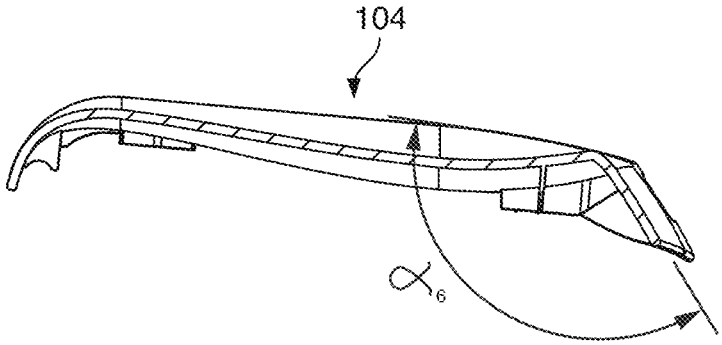
FIG. 27 shows still another illustrative apparatus in accordance with principles of this matter.

FIG. 27 shows a cross-sectional view of chair seat 104 taken along view lines 27-27. Table 17 lists the dimensions and corresponding ranges of chair seat 104.

TABLE 17

| Illustrative dimensions and corresponding ranges of chair seat 104. Illustrative dimensions | | | |
|---|---|---|---|
| Dimension | Lower limit (degrees) | Upper limit (degrees) | Example (degrees) |
| $\alpha_6$ | ≤45 | ≥275 | 129.8 |
| Other suitable dimension | Other suitable ranges | Other suitable ranges | Other suitable examples |

Figure 28:
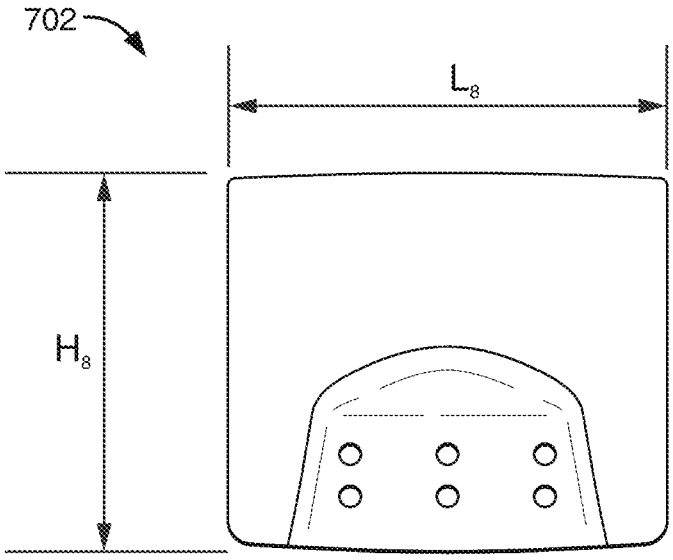
FIG. 28 shows an illustrative apparatus in accordance with principles of this matter.

FIG. 28 shows another view of steel plate 702. Table 18 lists the dimensions and corresponding ranges of steel plate 702.

TABLE 18

| Illustrative dimensions and corresponding ranges of steel plate 702. Illustrative dimensions | | | |
|---|---|---|---|
| Dimension | Lower limit (inches ) | Upper limit (inches) | Example (inches) |
| $L_8$ | ≤1 | ≥25 | 7.107 |
| $H_8$ | ≤1 | ≥25 | 6.148 |
| Other suitable dimensions | Other suitable ranges | Other suitable ranges | Other suitable examples |

Figure 29:
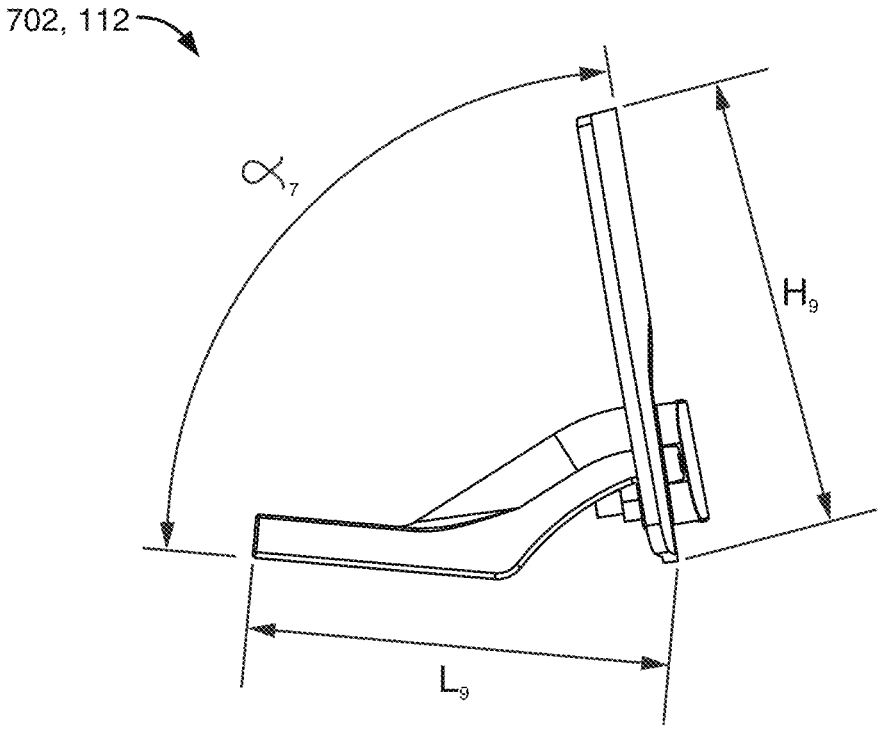
FIG. 29 shows another illustrative apparatus in accordance with principles of this matter.

FIG. 29 shows another view of steel plate 702 and bracket 112. Table 19 lists the dimensions and corresponding ranges of steel plate 702 and bracket 112.

TABLE 19

| Illustrative dimensions and corresponding ranges of steel plate 702 and bracket 112. Illustrative dimensions | | | |
|---|---|---|---|
| Dimension | Lower limit (inches ) | Upper limit (inches) | Example (inches) |
| $L_9$ | ≤1 | ≥25 | 5.728 |
| $H_9$ | ≤1 | ≥25 | 6.138 |
| $\alpha_7$ | ≤25° | ≥175° | 75.49° |
| Other suitable dimensions | Other suitable ranges | Other suitable ranges | Other suitable examples |

Thus, methods and systems for a chair are provided. Persons skilled in the art will appreciate that the present invention can be practiced by other than the described embodiments, which are presented for purposes of illustration rather than of limitation, and that the present invention is limited only by the claims that follow.

What is claimed is:

1. A chair comprising:
a chair back:
housing a steel plate; and
defining a first aperture, the first aperture exposing at least a portion of face of the steel plate, wherein the first aperture is in lower middle of the chair back;
a chair seat defining:
a back-to-front axis, said back of said back-to-front axis being adjacent to the chair back; and
defining a second aperture, wherein the second aperture is in middle of the chair seat adjacent the first aperture;
a steel bracket configured to connect an underside of the chair seat to the steel plate, the steel bracket extending through the second aperture;
a first chair support, said first chair support extending parallel to the back-to-front axis, said first chair support:
comprising two legs; and
being disposed on a first side of the chair seat;
a second chair support, said second chair support extending parallel to the back-to-front axis, said second chair support:
comprising two legs; and
being disposed on a second side of the chair seat;
a first bar configured to connect the first chair support to the second chair support; and
a second bar configured to connect the first chair support to the second chair support.

2. The chair of claim 1 wherein the chair seat comprises:
a seat pan; and
a rear facing lip, said rear facing lip:
defining the second aperture; and
extending beyond the seat pan.

3. The chair of claim 2 wherein the rear facing lip forms an obtuse angle with respect to the seat pan.

4. The chair of claim 2 wherein a curvature of the rear facing lip corresponds to a curvature of a lower portion of the chair back.

5. The chair of claim 1 wherein the first chair support further comprises a first stretcher, said first stretcher disposed between a front leg and a back leg of the first chair support;
wherein the first stretcher connects at:
a substantially right angle with the front leg; and
a rake angle with the back leg.

6. The chair of claim 5 wherein a portion of the first stretcher is disposed under a portion of the chair seat.

7. The chair of claim 1 wherein the second chair support further comprising a second stretcher, said second stretcher disposed between a front leg and a back leg of the second chair support;
wherein the second stretcher connects at:
a substantially right angle with the front leg; and
a rake angle with the back leg.

8. The chair of claim 7 wherein a portion of the second stretcher is disposed under a portion of the chair seat.

9. The chair of claim 1 wherein the chair back and the chair seat are formed from a poly-molded material.

10. The chair of claim 1 wherein:
the chair back is shaped with a linear bend across a horizontal axis, the linear bend separating an upper portion of the chair back from a lower portion of the chair back; and
the linear bend defining an obtuse angle between the upper portion of the chair back and the lower portion of the chair back.

11. The chair of claim 1 wherein the chair further comprises a book basket, the book basket configured to be connected flush with the underside of the chair seat.

12. The chair of claim 1 wherein the chair back further defines a U-shaped cavity, said U-shaped cavity configured for use as a hook and/or a handle.

13. A chair comprising:
a chair back:
shaped with a linear bend across a horizontal axis, the linear bend separating an upper portion of the chair back from a lower portion of the chair back;
defining an obtuse angle along the linear bend between the upper portion of the chair back and the lower portion of the chair back;
housing a steel plate in the lower portion; and
defining a first aperture, the first aperture exposing at least a portion of face of the steel plate, wherein the first aperture is in lower middle of the chair back;
a chair seat defining a back-to-front axis, said back of said back-to-front axis is adjacent to the chair back, the chair seat comprising:
a seat pan; and
a rear facing lip, said rear facing lip that:
defines a second aperture, wherein the second aperture is in middle of the chair seat adjacent the first aperture;
extends beyond the seat pan; and
includes a curvature that corresponds to a curvature of the lower portion of the chair back;
a steel bracket configured to connect an underside of the chair seat to the steel plate, the steel bracket extending through the second aperture; and
a chair support, said chair support configured to support the chair back, the chair seat and the steel bracket.

14. The chair of claim 13 wherein the rear facing lip forms an obtuse angle with respect to the seat pan.

15. The chair of claim 13 wherein a portion of the chair support extends beyond the chair seat.

16. The chair of claim 13 wherein the chair back and the chair seat are formed from a poly-molded material.

17. The chair of claim 13 wherein the chair further comprises a cover:
cover configured to fit into the first aperture;
configured to cover a back of the exposed face of the steel plate; and
formed from a poly-molded material.

18. The chair of claim 13 wherein the upper portion of the chair back includes a hook handle configured for use as:
a hook configured for holding a bookbag; and
a handle.

19. The chair of claim 13 wherein the chair support comprises a book basket configured to:
connect flush with the underside of the chair seat; and
store one or more items.

20. A chair comprising:
a chair back:
housing a steel plate; and
defining a first aperture, the first aperture exposing at least a portion of face of the steel plate, wherein the first aperture is in lower middle of the chair back;

a chair seat, said chair seat defining a second aperture, wherein the second aperture is in middle of the chair seat adjacent the first aperture;

a steel bracket configured to connect an underside of the chair seat to the steel plate, the steel bracket extending through the second aperture;

a first chair support:

comprising two legs; and being disposed on a first side of the chair seat;

a second chair support:

comprising two legs; and being disposed on a second side of the chair seat;

a first bar configured to connect the first chair support and the second chair support; and a second bar configured to connect the first chair support and the second chair support;

wherein, the first chair support and the second chair support run parallel to one another from the back of the chair to a front of the chair.

21. The chair of claim 20 wherein the chair seat includes:

a seat pan; and a rear facing lip, said rear facing lip:

defining the second aperture; and extending beyond the seat pan.

22. The chair of claim 21 wherein the rear facing lip forms an obtuse angle with respect to the seat pan.

23. The chair of claim 21 wherein a curvature of the rear facing lip corresponds to a curvature of a lower portion of the chair back.

24. The chair of claim 20, the first chair support further comprising a stretcher, said stretcher disposed between a front leg and a back leg;

wherein the stretcher connects at:

a substantially right angle with the front leg; and a rake angle with the back leg.

25. The chair of claim 24 wherein a portion of the stretcher of the first chair support is disposed under a portion of the chair seat.

26. The chair of claim 20, the second chair support further comprising a stretcher, said stretcher disposed between a front leg and a back leg;

wherein the stretcher connects at:

a substantially right angle with the front leg; and a rake angle with the back leg.

27. The chair of claim 26 wherein a portion of the stretcher of the second chair support is disposed under a portion of the chair seat.

28. The chair of claim 20 wherein the chair back and the chair seat are formed from a poly-molded material.

29. The chair of claim 20 wherein:

the chair back is shaped with a linear bend across a horizontal axis, the linear bend separates an upper portion of the chair back from a lower portion of the chair back; and the linear bend defines an obtuse angle between the upper portion of the chair back and the lower portion of the chair back.

* * * * *